US005230983A

United States Patent [19]

Inoue et al.

[11] Patent Number: 5,230,983

[45] Date of Patent: Jul. 27, 1993

[54] SILVER HALIDE PHOTOGRAPHIC MATERIAL

[75] Inventors: Nobuaki Inoue; Minoru Sakai; Shoji Yasuda, all of Kanagawa, Japan

[73] Assignee: Fuji Photo Film Co., Ltd., Kanagawa, Japan

[21] Appl. No.: 684,087

[22] Filed: Apr. 12, 1991

[30] Foreign Application Priority Data

Apr. 13, 1990 [JP] Japan ..... 2-98387
Apr. 13, 1990 [JP] Japan ..... 2-98391
May 14, 1990 [JP] Japan ..... 2-123684

[51] Int. Cl.[5] ..... G03C 1/06

[52] U.S. Cl. ..... 430/264; 430/223; 430/957

[58] Field of Search ..... 430/264, 223, 957

[56] References Cited

U.S. PATENT DOCUMENTS 4,168,977 9/1979 Takada et al. ..... 430/264
4,221,857 9/1980 Okutsu et al. ..... 430/264
4,311,781 1/1982 Mifume et al. ..... 430/264
4,619,884 10/1986 Singer ..... 430/223
4,684,604 8/1987 Harder ..... 430/223
4,737,442 4/1988 Yagihara et al. ..... 430/264
4,770,990 9/1988 Nakamura et al. ..... 430/957
4,956,257 9/1990 Inoue ..... 430/264
5,085,971 2/1992 Katoh et al. ..... 430/264
5,124,231 6/1992 Sakai et al. ..... 430/264
5,145,765 9/1992 Okamura et al. ..... 430/264

FOREIGN PATENT DOCUMENTS 0395069 10/1990 European Pat. Off. .
0237444 10/1987 Japan .
0187542 7/1989 Japan .

OTHER PUBLICATIONS

Patent Abstracts of Japan, vol. 13, No. 291 (P-893)(3639) Jul. 6, 1989, & JP-A-01 072140 (Konica Corporation) Mar. 17, 1989.
Communication dated Jul. 24, 1991.
European Search Report dated Jul. 18, 1991.

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A negative-working type silver halide photographic material comprising a support having thereon at least one light-sensitive silver halide emulsion layer containing a hydrazine derivative, wherein the emulsion layer or another hydrophilic colloidal layer provided on the support contains at least one redox compound capable of releasing a development inhibitor upon oxidation, and the silver halide emulsion comprises of monodispersed silver halide grains comprising 50 mol % or more of silver chloride.

16 Claims, 1 Drawing Sheet

SILVER HALIDE PHOTOGRAPHIC MATERIAL

FIELD OF THE INVENTION

The present invention relates to a silver halide photographic material for the formation of an ultrahigh contrast negative image. More particularly, the present invention relates to an ultrahigh contrast negative-working type silver halide photographic material suitable for photomechanical processing.

BACKGROUND OF THE INVENTION

In the field of photomechanical processing, it has been desired to use photographic light-sensitive materials excellent in original reproducibility, stable processing solutions and simplified replenishment methods to cope with diversification and complexity of printed material.

In particular, line originals to be subjected to the process of picture taking normally comprise photocomposed letters, handwritten letters, illustrations, dot photographs, etc. Thus, line originals are normally formed of a mixture of images having different densities and line widths. Therefore, the ability to provide plate-making cameras, photographic light-sensitive materials or image formation methods which can give an excellent reproduction of these originals have been sought.

On the other hand, enlargement or reduction of dot photographs is widely conducted to make plates for catalogues or large-sized posters. In the dot enlargement process, the number of lines per square inch decreases, giving an unsharp picture. In the dot reduction process, the number of lines per square inch becomes greater than that of the original, giving a fine picture. Accordingly, an image formation method has been desired which provides a wider latitude to maintain an excellent reproducibility of dot gradation.

As a light source for plate-making cameras, halogen lamps or xenon lamps have been employed. In order to be sufficiently sensitive to these light sources, light-sensitive materials are normally subjected to orthochromatic sensitization. However, it has been found that photographic light-sensitive materials which have been orthochromatically sensitized are more susceptible to effects of chromatic aberration of the lens which can deteriorate the picture quality, particularly when a xenon lamp is used.

In a known method for meeting the demand for wide latitude, a lithographic silver halide photographic material comprising silver bromochloride (at least having a silver chloride content of 50% or more) is processed with a hydroquinone developer having an extremely low effective concentration of sulfurous ions (normally 0.1 mol/l or less) so that line originals or dot images having a high contrast and blackened density on the image portion and the nonimage portion are definitely distinguished from each other. However, this method is disadvantageous in that the development is extremely unstable to air oxidation due to the low sulfurous acid concentration of the developer. In order to stabilize the activity of the developer, various efforts and measures must be made. Furthermore, this method provides a remarkably low processing speed, lowering the working efficiency.

Thus, an image formation method has been desired which encompasses development with a processing solution having an excellent storage stability to provide an ultrahigh contrast while eliminating the instability in the formation of images by the above mentioned development method (lithographic development system). In a system as proposed in U.S. Pat. Nos. 4,166,742, 4,168,977, 4,221,857, 4,224,401, 4,243,739, 4,272,606, and 4,311,781, a surface latent image type silver halide photographic material comprising a specific acylhydrazine compound is processed with a developer with a pH value of 11.0 to 12.3 containing 0.15 mol/l or more of a sulfurous acid preservative and having an excellent storage stability to form an ultrahigh contrast negative image where $\gamma$ is more than 10. This new image formation system is characterized in that it can use silver bromoiodide and silver bromochloroiodide while the prior art ultrahigh contrast image formation systems can use only silver bromochloride having a high silver chloride content.

The aforementioned image formation system is adequate in view of dot sharpness, processing stability and rapidity, and original reproducibility. However in order to cope with the recent diversification of printed matters, a system has been desired which provides a greater stability and higher original reproducibility.

A light-sensitive material comprising a redox compound which undergoes oxidation to release a photographically useful group is disclosed in JP-A-61-213847 (the term "JP-A" as used herein means an "unexamined published Japanese patent application") and 64-72140, and U.S. Pat. No. 4,684,604. A system using silver bromochloride is disclosed in JP-A-60-83028, 60-112034, 62-235947, and 63-103232. These proposals are intended to widen the reproduction range of gradation. However, in an ultrahigh processing system using a hydrazine derivative, such a redox compound inhibits the improvement of contrast, making it impossible to make use of the features of the system.

In a silver halide photographic material which comprises hydrazines, the percent swelling has a great effect on the photographic properties as disclosed in JP-A-62-237444, 63-96033 and 1-187542.

SUMMARY OF THE INVENTION

It is an object of the present invention to provide a silver halide photographic material which gives excellent picture qualities such as line original reproducibility, enlargeability and reducibility.

It is another object of the present invention to provide a silver halide photographic material which is barely subject to a drop in sensitivity, $\gamma$ and Dmax even when the processing of a large amount of films causes a reduction in the pH value of the processing solution or a rise in the bromine ion concentration of the processing solution.

It is a further object of the present invention to provide a plate-making light-sensitive material which can be processed with a highly stable developer to obtain a high contrast image.

It is a still further object of the present invention to provide a plate-making silver halide photographic material comprising a hydrazine compound which can give a high dot quality and a wide dot gradation.

It is a further object of the present invention to provide a plate-making silver halide photographic material comprising a hydrazine compound which can be desirably prevent the occurrence of black pepper.

These and other objects of the present invention will become more apparent from the following detailed description and examples.

The above and other objects and advantages of the present invention are accomplished by a negative-working type silver halide photographic material comprising a support having thereon at least one light-sensitive silver halide emulsion layer containing a hydrazine derivative, wherein the emulsion layer or another hydrophilic colloidal layer provided on the support contains at least one redox compound capable of releasing a development inhibitor upon oxidation, and the silver halide emulsion comprises monodispersed silver halide grains comprising 50 mol % or more of silver chloride.

BRIEF DESCRIPTION OF THE DRAWINGS

By way of example and to clarify the description, reference is made to the accompanying drawings in which.

DETAILED DESCRIPTION OF THE INVENTION

Figure 1:
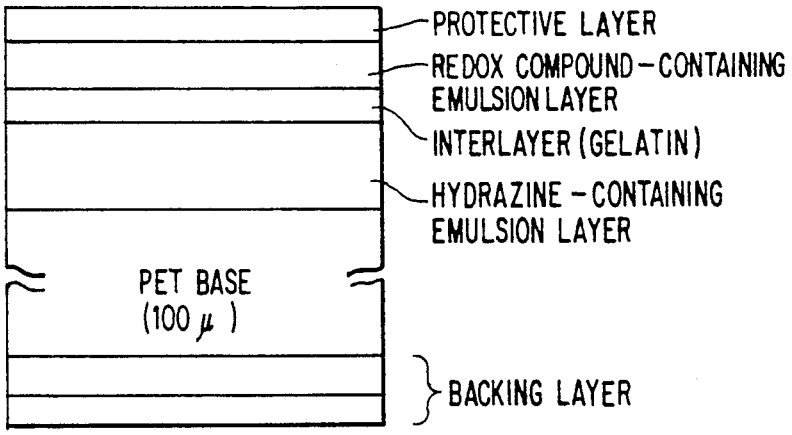
FIG. 1 is a block diagram of a section of the samples in Example 1.

The hydrazine derivative in the emulsion layer is preferably a compound represented by formula (I):

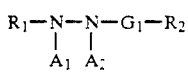

(I)

wherein $R_1$ represents an aliphatic or aromatic group; $R_2$ represents a hydrogen atom, alkyl group, aryl group, alkoxy group, aryloxy group, amino group or hydrazino group; $G_1$ represents

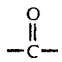

group, $—SO_2—$ group, —SO— group,

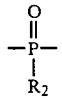

group,

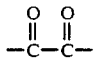

group, thiocarbonyl group or iminomethylene group; and $A_1$ and $A_2$ each represents a hydrogen atom or one of $A_1$ and $A_2$ represents a hydrogen atom and the other represents a substituted or unsubstituted alkylsulfonyl group, substituted or unsubstituted arylsulfonyl group or substituted or unsubstituted acyl group.

In formula (I), the aliphatic group represented by $R_1$ is preferably a $C_{1-30}$, particularly $C_{1-20}$ straight-chain, branched or cyclic alkyl group which may contain substituents.

In formula (I), the aromatic group represented by $R_1$ is a monocyclic or bicyclic aryl group or an unsaturated heterocyclic group which may be condensed with aryl groups.

Preferred among the groups represented by $R_1$ are aryl groups. Particularly preferred among the groups represented by $R_1$ are aryl groups containing benzene rings.

The aliphatic or aromatic group represented by $R_1$ may be substituted. Typical examples of such substituents include alkyl group, aralkyl group, alkenyl group, alkynyl group, alkoxy group, aryl group, substituted amino group, ureido group, urethane group, aryloxy group, sulfamoyl group, carbamoyl group, alkylthio group, arylthio group, alkylsulfonyl group, arylsulfonyl group, alkylsulfinyl group, arylsulfinyl group, hydroxyl group, halogen atom, cyano group, sulfo group, aryloxycarbonyl group, acyl group, alkoxycarbonyl group, acyloxy group, carbonamide group, sulfonamide group, carboxyl group, phosphoric amide group, diacylamino group, imide group, and

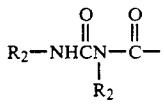

group. Particularly preferred among these substituents are alkyl group (preferably $C_{1-20}$), aralkyl group (preferably $C_{7-30}$), alkoxy group (preferably $C_{1-20}$), substituted amino group (preferably $C_{1-20}$ alkyl group-substituted amino group), acylamino group (preferably $C_{2-30}$), sulfonamide group (preferably $C_{1-30}$), ureido group (preferably $C_{1-30}$, and phosphoric amide group (preferably $C_{1-30}$).

In formula (I), the alkyl group represented by $R_2$ is preferably a $C_{1-4}$ alkyl group. The aryl group represented by $R_2$ is preferably a monocyclic or bicyclic aryl group (containing e.g., benzene rings).

In formula (1), most preferred among the groups represented by G is

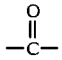

group.

If $G_1$ is

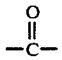

group, preferred among the groups represented by $R_2$ are hydrogen atom, alkyl group (e.g., methyl, trifluoromethyl, 3-hydroxypropyl, 3-methanesulfonamidepropyl, phenylsulfonylmethyl), aralkyl group (e.g., o-hydroxylbenzyl), aryl group (e.g., phenyl, 3,5-dichlorophenyl, o-methanesulfonamidephenyl, and 4-methanesulfonylphenyl, 2-hydroxymethylphenyl). Particularly preferred among these groups is a hydrogen atom.

$R_2$ may be substituted. The substituents there can be used those described with reference to $R_1$.

$R_2$ may be a group which causes a cyclization reaction in which the $G_1$-$R_2$ portion is separated from the remainder of the molecule to produce a cyclic structure containing atoms contained in $G_1$-$R_2$ portion. Examples of such a group include those disclosed in JP-A-63-29751.

Most preferred among the groups represented by $A_1$ and $A_2$ is a hydrogen atom.

In formula (I), $R_1$ or $R_2$ may contain a ballast group or polymer commonly incorporated in immobile photographic additives such as a coupler. Such a ballast group is a group containing 8 or more carbon atoms which is relatively inert to photographic properties. Such a group can be selected from alkyl group, alkoxy group, phenyl group, alkylphenyl group, phenoxy group, alkylphenoxy group, etc. Examples of the above-mentioned polymers include those disclosed in JP-A-1-100530.

In formula (I), $R_1$ or $R_2$ may contain a group which intensifies the adsorption on the surface of silver halide grains. Examples of such an adsorption group include thiourea group, heterocyclic thioamide group, mercaptoheterocyclic group, and triazole group as disclosed in U.S. Pat. Nos. 4,385,108, and 4,459,347, JP-A-59-195233, 59-200231, 59-201045, 59-201046, 59-201047, 59-201048, 59-201049, 61-170733, 63-270744, 63-234244, 63-234246, and 62-948, and Japanese Patent Application No. 62-67501.

Specific examples of the compounds represented by formula (I) will be set forth below, but the present invention should not be construed as being limited thereto.

I-1

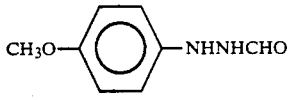

I-2

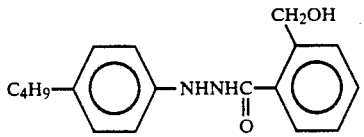

I-3

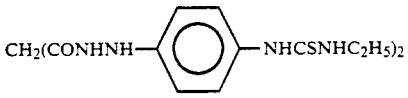

I-4

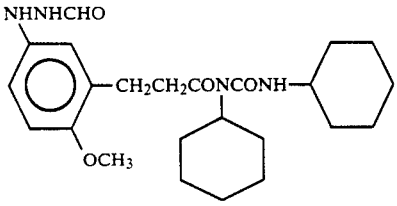

I-5

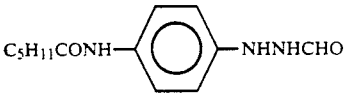

I-6

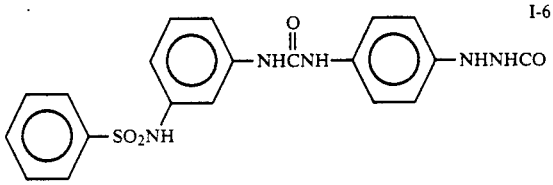

I-7

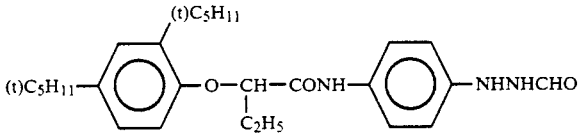

I-8

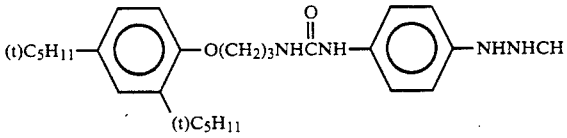

I-9

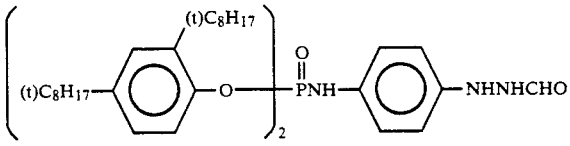

I-10

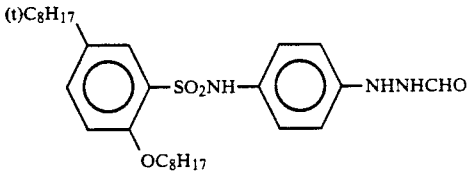

I-11

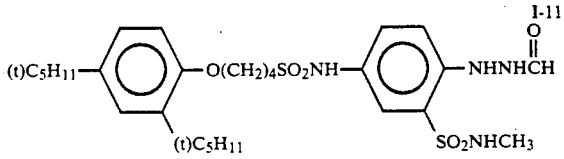

-continued
I-12
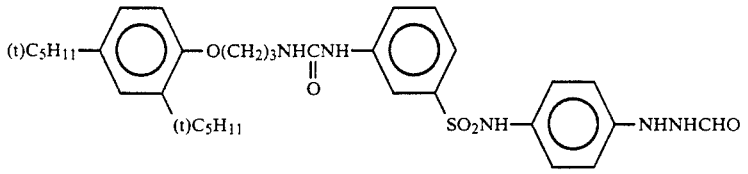
I-13
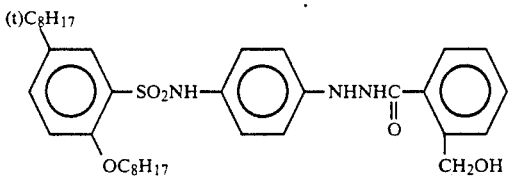
I-14
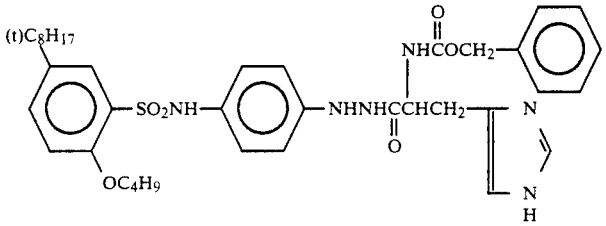
I-15
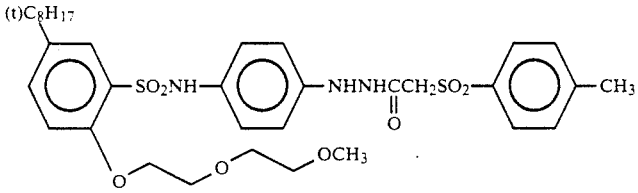
I-16
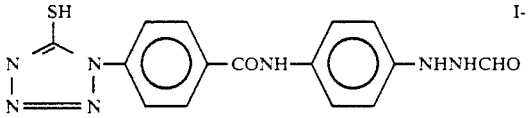
I-17
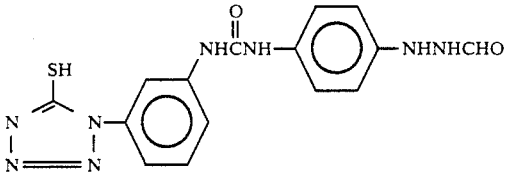
I-18
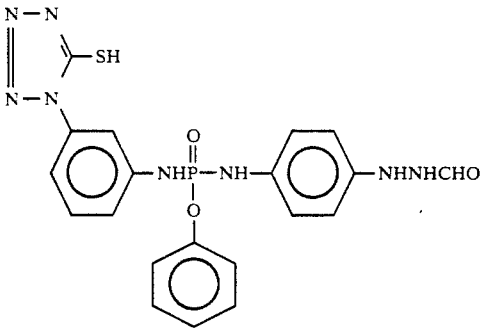
I-19
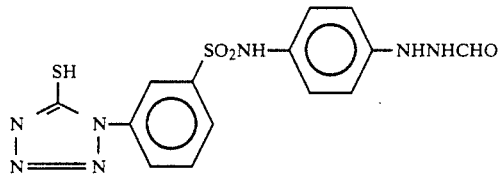
I-20
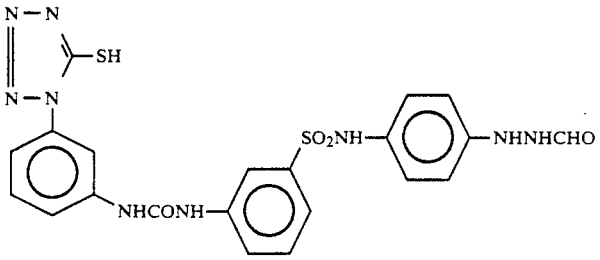

-continued

I-21

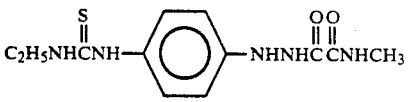

I-22

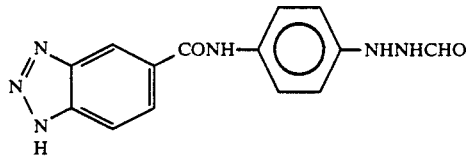

I-23

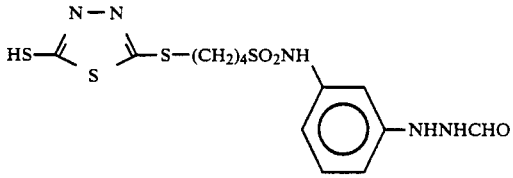

I-24

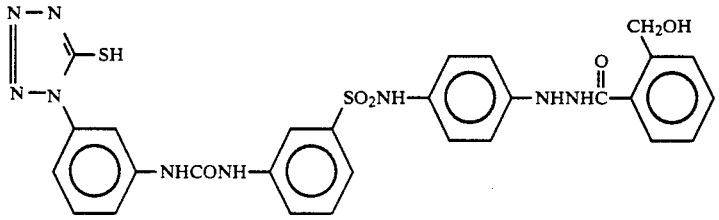

I-25

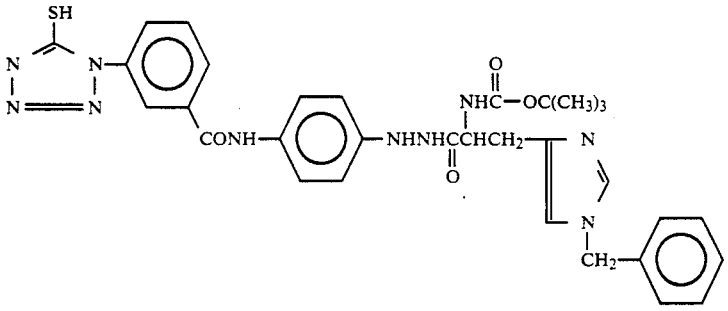

I-26

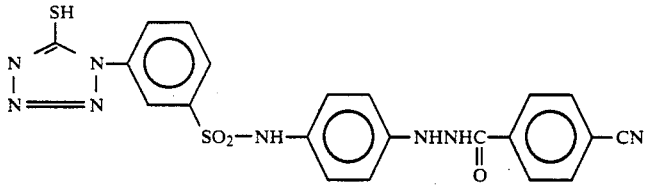

Other examples of hydrazine derivatives which can be used in the present invention include those described in *Research Disclosure* Item 23516 (November 1983, page 346), and the literature cited therein, U.S. Pat. No.s 4,080,207, 4,269,929, 4,276,364, 4,278,748, 4,385,108, 4,459,347, 4,560,638, 4,478,928, and 4,686,167, British Patent 2,011,391B. EP 217,310, JP-A-60-179734, 62-270948, 63-29751, 61-170733, 61-270744, 62-948, 62-178246, 63-32538, 63-104047, 63-121838, 63-129337, 63-223744, 63-234244, 63-234245, 63-234246, 63-294552, 63-306438, 1-100530, 1-105941, 1-105943, 64-10233, 1-90439, 1-276128, 1-283548, 1-280747, 1-283549, 1-285940, 2-2541, and 2-77057, and Japanese Patent Application Nos. 3-179760, 1-18377, 1-18378, 1-18379, 1-15755, 1-16814, 1-40792, 1-42615, 1-42616, 1-123693, and 1-126284.

The amount of the hydrazine derivative to be incorporated in the present silver halide photographic material is preferably in the range of about $1\times10^{-6}$ mol to about $5\times10^{-2}$ mol, more preferably $1\times10^{-5}$ mol to $2\times10^{-2}$ mol per mol of silver halide contained in the silver halide emulsion layer containing the hydrazine derivative.

The present redox compound which undergoes oxidation to release a development inhibitor will be described hereinafter.

Preferred examples of redox groups included in the redox compound include hydroquinones, catechols, naphthohydroquinones, aminophenols, pyrazolidones, hydrazines, hydroxylamines, and reductones. Particularly preferred among these redox groups are hydrazines.

The hydrazines contained in the present redox compound are preferably represented by formula (II-1), (II-2) or (II-3). Particularly preferred among these compounds are those represented by formula (II-1).

$$R_{11}-\underset{A_{11}}{N}-\underset{A_{12}}{N}-G_{11}-(\text{Time})_t-\text{PUG} \qquad \text{(II-1)}$$

-continued $$R_{11}-G_{12}-G_{11}-\underset{\underset{A_{11}}{|}}{N}-\underset{\underset{A_{13}}{|}}{N}-CH_2\underset{\underset{A_{14}}{|}}{CH}-(Time)_t-PUG \quad \text{(II-2)}$$

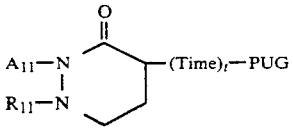

(II-3)

these formulae, $R_{11}$ represents an aliphatic group or aromatic group. $G_{11}$ represents $$-\overset{O}{\overset{\|}{C}}-\text{ group, } -\overset{O}{\overset{\|}{C}}-\overset{O}{\overset{\|}{C}}-\text{ group, } -\overset{S}{\overset{\|}{C}}-\text{ group,}$$

$$-\overset{N-G_{11}-R_{12}}{\overset{\|}{C}}-\text{ group, } -SO-\text{ group,}$$

$$-SO_2-\text{ group or } -\overset{O}{\overset{\|}{\underset{\underset{G_{12}-R_{12}}{|}}{P}}}-\text{ group.}$$

$G_{12}$ represents a mere bond, —O—, —S— or $$-\overset{R_{12}}{\overset{|}{N}}-.$$

$R_{12}$ represents a hydrogen atom or one of the groups defined for $R_{11}$.

$A_{11}$ and $A_{12}$ each represents a hydrogen atom, alkylsulfonyl group, arylsulfonyl group or acyl group, all of which may be substituted or unsabstituted. In formula (II-1), at least one of $A_{11}$ and $A_{12}$ is a hydrogen atom. $A_{13}$ has the same meaning as $A_{11}$ or represents $$-CH_2\underset{\underset{A_{14}}{|}}{CH}\leftarrow Time)_t-PUG.$$

$A_{14}$ represents a nitro group, cyano group, carboxyl group, sulfo group or $-G_{11}-G_{12}-R_{11}$.

Time represents a divalent linking group, and t represents an integer 0 or 1. PUG represents a development inhibitor.

Formulae (II-1), (II-2) and (II-3) will be further described hereinafter.

In formulae (II-1), (II-2) and (II- 3), the aliphatic group represented by $R_{11}$ is preferably a $C_{1-30}$, particularly $C_{1-20}$ straight-chain, branched or cyclic alkyl group, all of which may contain substituents.

In formulae (II-1), (II-2) and (II- 3), the aromatic group represented by $R_{11}$ is a monocyclic or bicyclic aryl group or an unsaturated heterocyclic group which may be condensed with aryl groups to form a heteroaryl group.

Examples of such an aromatic group include benzene ring, naphthalene ring, pyridine ring, quinoline ring, and isoquinoline ring. Particularly preferred are those containing a benzene ring or rings.

Particularly preferred among the groups represented by $R_{11}$ are aryl groups.

The aryl group or unsaturated heterocyclic group represented by $R_{11}$ may contain substituents. Typical examples of such substituents include alkyl group, aralkyl group, alkenyl group, alkynyl group, alkoxy group, aryl group, substituted amino group, ureido group, urethane group, aryloxy group, sulfamoyl group, carbamoyl group, alkylthio group, arylthio group, sulfonyl group, sulfinyl group, hydroxyl group, halogen atom, cyano group, sulfo group, aryloxycarbonyl group, acyl group, alkoxycarbonyl group, acyloxy group, carbonamide group, sulfonamide group, carboxyl group, and phosphoric amide group. Preferred among these substituents are straight-chain, branched or cyclic alkyl group (preferably $C_{1-20}$), aralkyl group (preferably $C_{7-30}$), alkoxy group (preferably $C_{1-30}$), substituted amino group (preferably $C_{1-30}$ alkyl-substituted amino group), acylamino group (preferably $C_{2-40}$), sulfonamide group (preferably $C_{1-40}$), ureido group (preferably $C_{1-40}$), and phosphoric amide group (preferably $C_{1-40}$).

In formulae (II-1), (II-2) and (II-3), $G_{11}$ is preferably $$-\overset{O}{\overset{\|}{C}}-$$

group or $-SO_2-$ group, most preferably $$-\overset{O}{\overset{\|}{C}}-$$

group.

$A_{11}$ and $A_{12}$ each is preferably a hydrogen atom. $A_{13}$ is preferably a hydrogen atom or $$-CH_2-\underset{\underset{A_{14}}{|}}{CH}\leftarrow Time)_t-PUG.$$

In formulae (II-1), (II-2) and (II- 3), Time represents a divalent linking group which may serve to adjust the timing of the releasable group.

The divalent linking group represented by Time represents a group which causes PUG to be released from Time-PUG which has in turn been released from an oxidation product of a redox nucleus through a reaction in one or more stages.

Examples of the divalent linking group represented by Time include linking groups which undergo an intramolecular ring closure reaction of a p-nitrophenoxy derivative to release PUG as described in U.S. Pat. No. 4,248,962 (JP-A-54-145135), linking groups which undergo an intramolecular ring closure reaction after a ring cleavage to release PUG as described in U.S. Pat. Nos. 4,310,612 (JP-A-55-53330) and 4,358,525, linking groups which undergo an intramolecular ring closure reaction of a carboxyl group in succinic monoester or an analogous compound thereof to release PUG while producing an acid anhydride as described in U.S. Pat. Nos. 4,330,617, 4,446,216 and 4,483,919, and JP-A-59-121328, linking groups which undergo an electron migration via a double bond by which an aryloxy group or heterocyclic oxy group is conjugated to release PUG while producing quinomonomethane or analogous compounds thereof as described in U.S. Pat. Nos. 4,409,323, 4,421,845, and 4,416,977 (JP-A-57-135944), *Research Disclosure* No. 21,228 (December 1981), and JP-A-58-209736 and 58-209738, linking groups which undergo an electron migration in a portion having a nitrogen-containing heterocyclic enamine structure to release PUG from the γ-position of enamine as described in U.S. Pat. No. 4,420,554 (JP-A-57-136640), and JP-A-57-135945, 57-188035, 58-98728, and 58-209737, linking groups which undergo an electron migration to a carbonyl group conjugated with a nitrogen atom in a nitrogen-containing heterocyclic group to produce an oxy group which undergoes an intramolecular ring closure reaction to release PUG as described in JP-A-57-56837, linking groups which release PUG with the formation of an aldehyde as described in U.S. Pat. No. 4,146,396 (JP-A-52-90932), and JP-A-59-93442, 59-75475, 60-249148, and 60-249149, linking groups which release PUG with the decarboxylation of a carboxyl group as described in JP-A-51-146828, 57-179842 and 59-104641, linking groups having a —O—COO-$CR_aR_b$-PUG (in which $R_a$ and $R_b$ each represents a monovalent group) structure which produce PUG with the formation of an aldehyde following decarboxylation, linking groups which release PUG with the formation of isocyanate as described in JP-A-60-7429, and linking groups which undergo coupling reaction with an oxidation product of a color developing agent to release PUG as described in U.S. Pat. No. 4,438,193.

Specific examples of the divalent linking group represented by Time are further described in JP-A-61-236549, and 1-269936.

PUG represents a group which exhibits the effect of inhibiting development in the form of $$(\text{Time})_t\text{PUG}$$

or PUG.

The development inhibitor represented by PUG or $$(\text{Time})_t\text{PUG}$$

is a known development inhibitor containing a hetero atom through which a bond is made. Examples of such a known development inhibitor are described in C. E. K. Mees & T. H. James, *The Theory of Photographic Processes,* 3rd ed., 1966, Macmillan, p 344–346.

The development inhibitor represented by PUG may contain substituents. Examples of such substituents include those described with reference to $R_{11}$ above. These substituents be further substituted.

Preferred examples of such substituents include nitro group, sulfo group, carboxyl group, sulfamoyl group, phosphono group, phosphinico group, and sulfonamide group.

In formulae (II-1), (II-2) and (II- 3), $R_{11}$ or $$(\text{Time})_t\text{PUG}$$

may contain a ballast group commonly incorporated in immobile photographic additives such as a coupler, or a group which accelerates adsorption of the compound represented by formula (II-1), (II-2) or (II-3) onto silver halide.

The ballast group is an organic group which provides the compound represented by formula (II-1), (II-2) or (II-3) with enough molecular weight to prevent the compound from diffusing into other layers or the processing solution. The ballast group comprises a combination of alkyl group, aryl group, heterocyclic group, ether group, thioether group, amide group, ureido group, urethane group, sulfonamide group, etc. A ballast group containing substituted benzene rings may preferably be used; more preferably a ballast group containing branched alkyl-substituted benzene rings may be used.

Specific examples of the group which accelerates the adsorption onto silver halide include cyclic thioamide groups such as 4-thiazoline-2-thione, 4-imidazoline-2-thione, 2-thiohydantoin, rhodanine, thiobarbituric acid, tetrazoline-5-thione, 1,2,4-triazoline-3-thione,1,3,4-oxazoline-2-thione, benzimidazoline-2-thione, benzoxazoline-2-thione, benzothiazoline-2-thione, thiotriazine, and 1,3-imidazoline-2-thione, chain thioamide groups, aliphatic mercapto groups, aromatic mercapto groups, heterocyclic mercapto groups (if the atom adjacent to the carbon atom to which the —SH group is bonded is a nitrogen atom, the heterocyclic mercapto groups have the same meaning as the cyclic thioamide groups of which they are tautomers; specific examples of these heterocyclic mercapto groups include those exemplified above), groups containing disulfide bond, nitrogen-containing heterocyclic groups containing 5 or 6 members comprising a combination of nitrogen, oxygen, sulfur and carbon, such as benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene, heterocyclic quaternary salts such as benzimidazolinium.

These adsorption accelerating groups may be further substituted by proper substituents. Examples of such substituents include those described with reference to $R_{11}$ above.

Specific examples of the redox compound which can be used in the present invention will be set forth below, but the present invention should not be construed as being limited thereto.

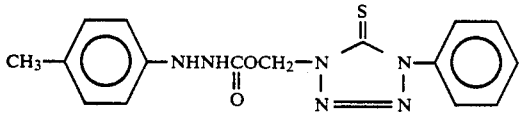

II-1

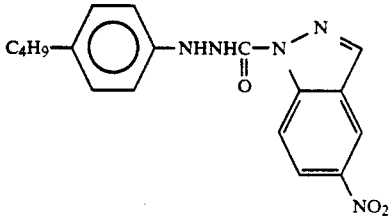

II-2

-continued
II-3
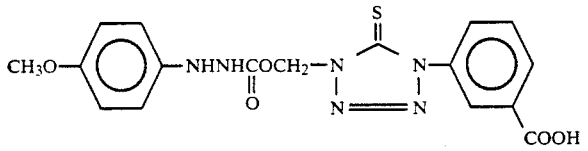
II-4
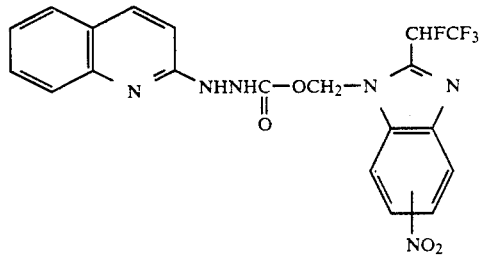
II-5
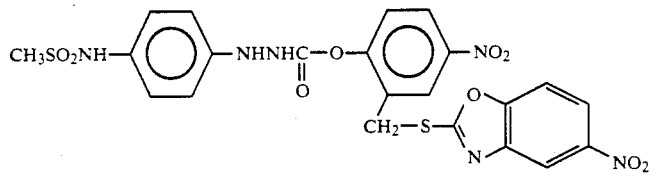
II-6
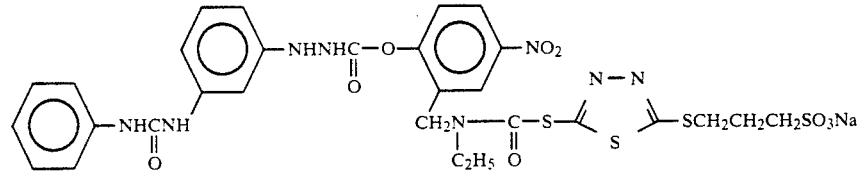
II-7
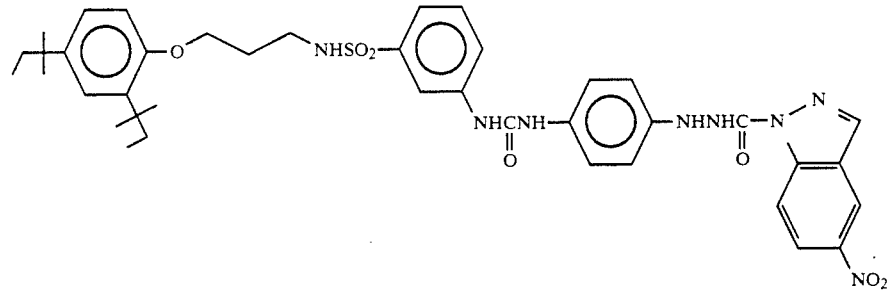
II-8
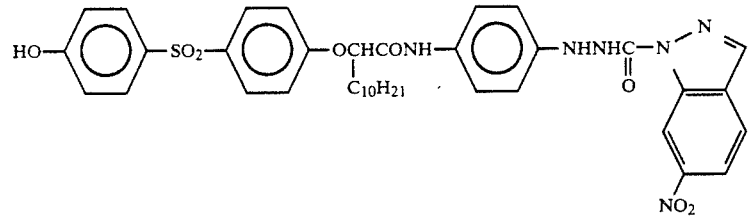
II-9
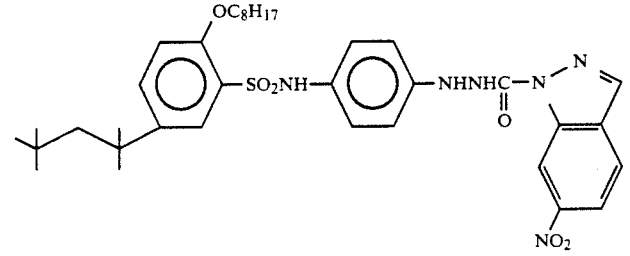

-continued
II-10
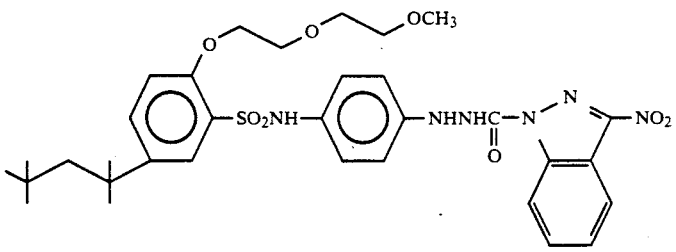
II-11
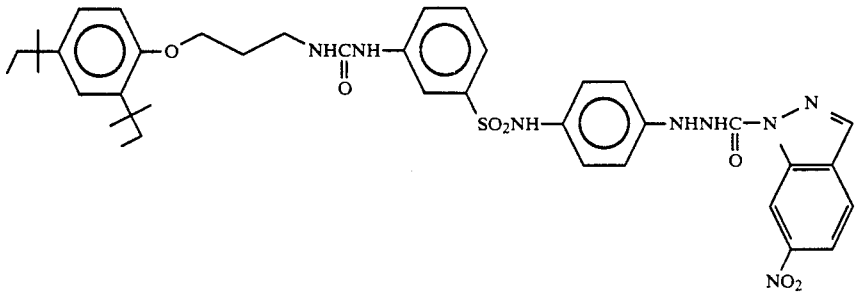
II-12
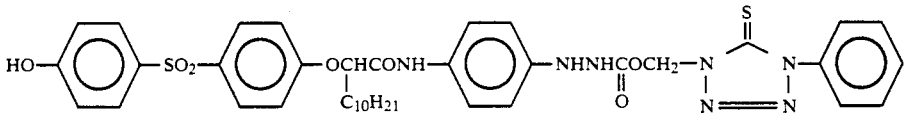
II-13
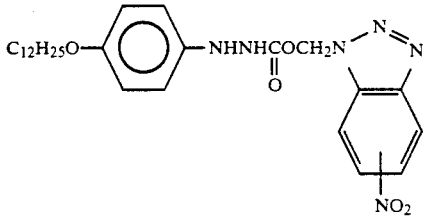
II-14
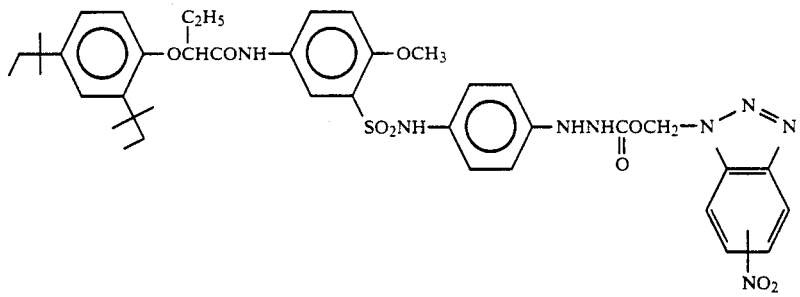
II-15
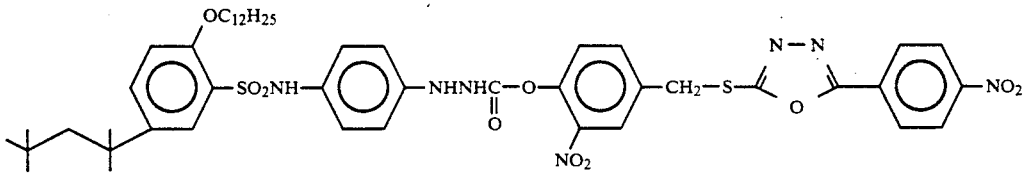
II-16
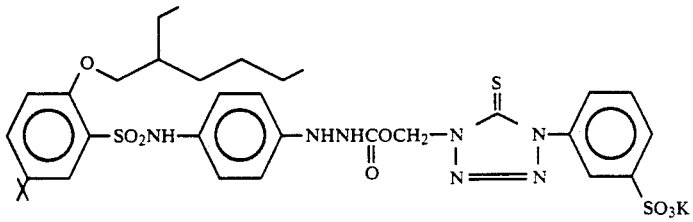

-continued
II-17
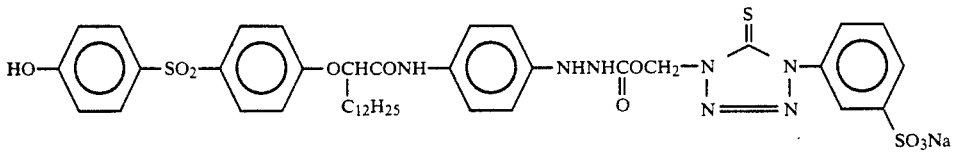
II-18
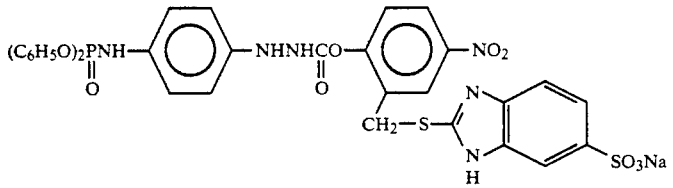
II-19
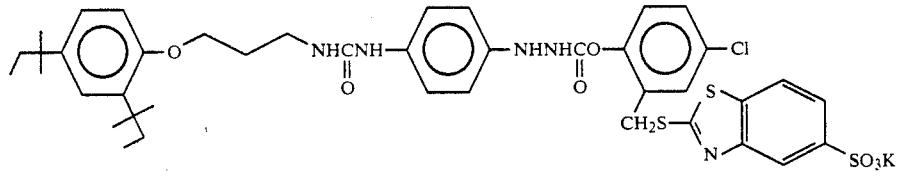
II-20
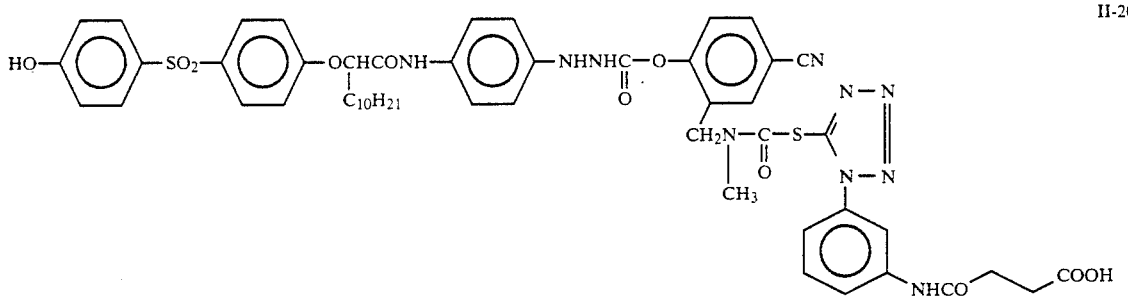
II-21
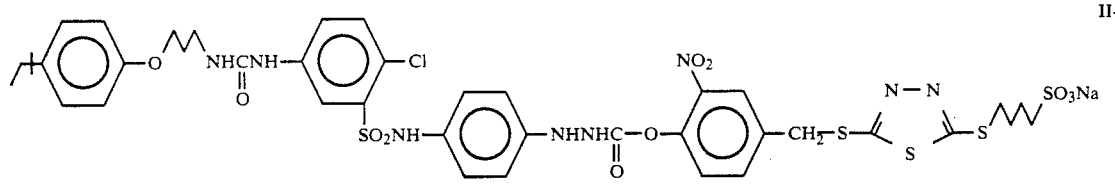
II-22
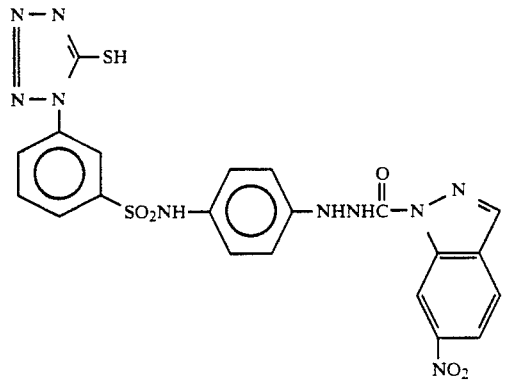

-continued
II-23
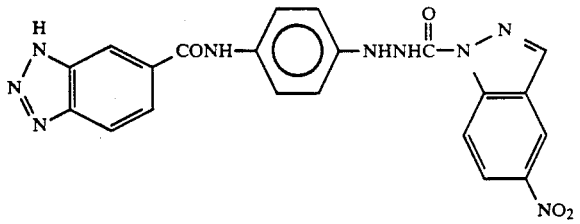
II-24
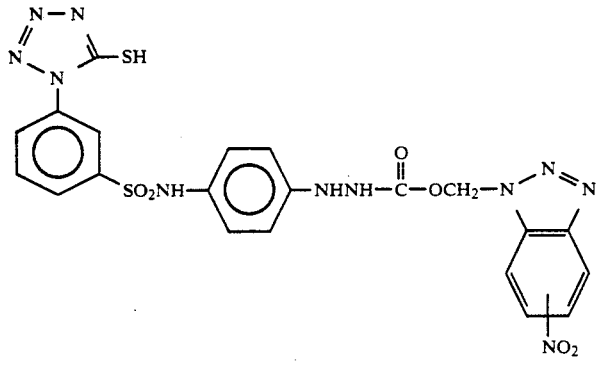
II-25
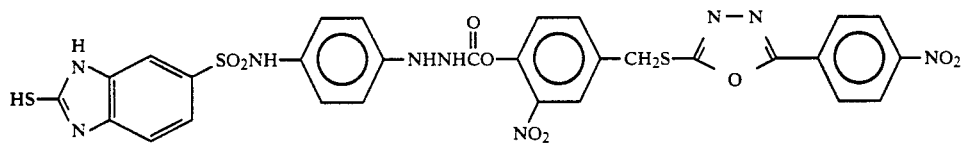
II-26
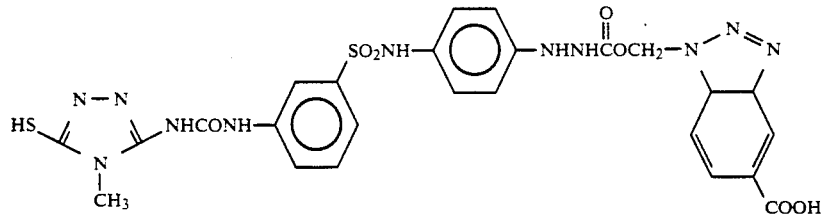
II-27
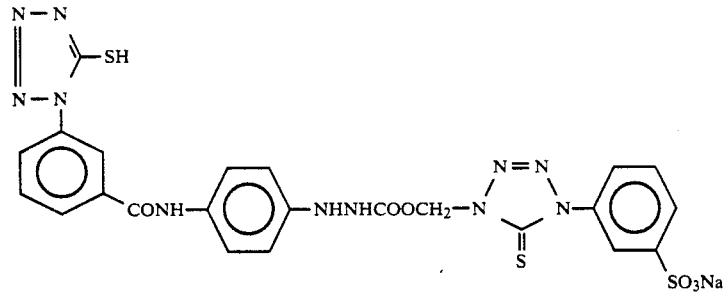
II-28
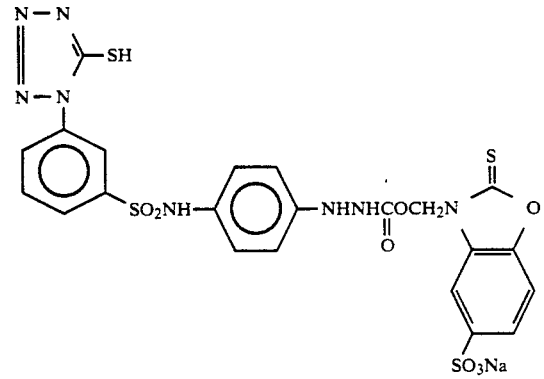

-continued
II-29
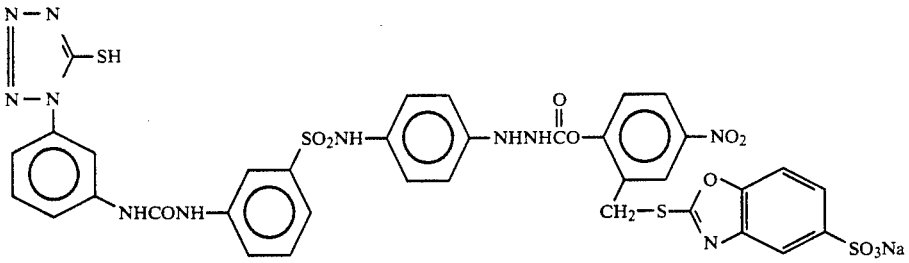
II-30
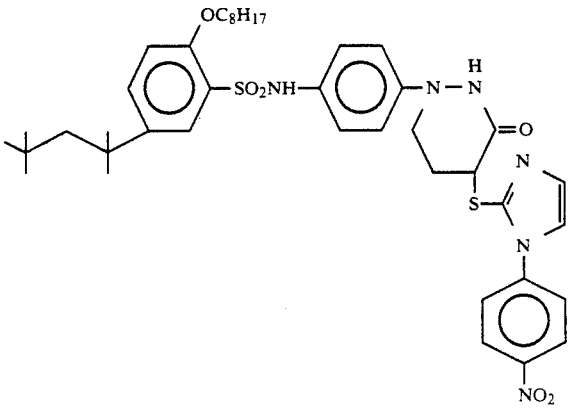
II-31
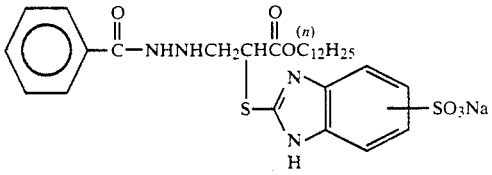
II-32
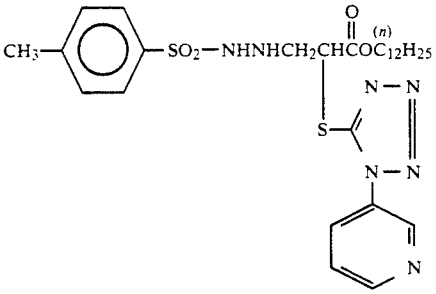
II-33
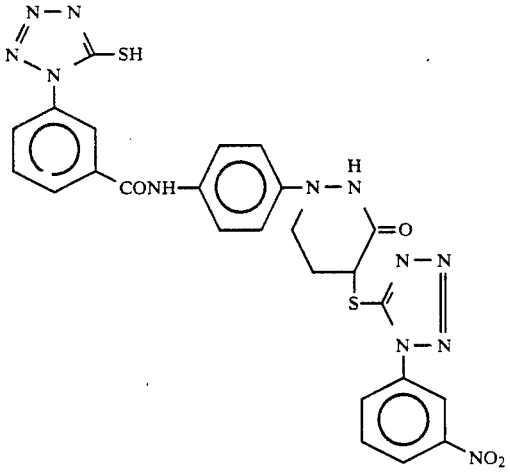

-continued

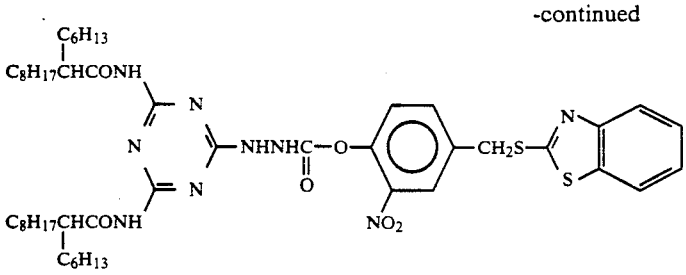

II-34

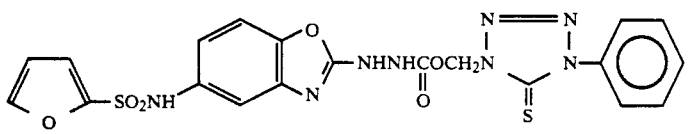

II-35

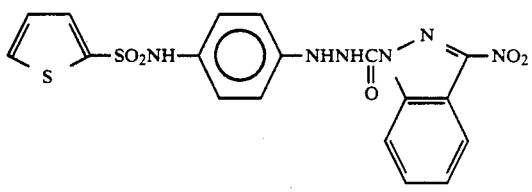

II-36

Other examples of the redox compound which can be used in the present invention include those described in JP-A-61-13847, and 62-260153, and Japanese Patent Application Nos. 1-102394, 1-102395, and 1-114455.

Examples of the synthesis of the redox compounds to be used in the present invention are described in JP-A-61-213847, 62-260153, 49-129536, 56-153336, 56-153342, and 1-269936, and U.S. Pat. Nos. 4,684,604, 3,379,529, 3,620,746, 4,377,634, and 4,332,878.

The redox compound of the present invention can be used in an amount of about $1\times10^{-6}$ mol to about $5\times10^{-2}$ mol, preferably $1\times10^{-5}$ to $1\times10^{-2}$ mol, per mol of silver halide contained in the layer in which the redox compound is added and in a layer or layers adjacent thereto.

The redox compound of the present invention can be used in the form of solution in a proper water-miscible organic solvent such as alcohol (e.g., methanol, ethanol, propanol, fluorinated alcohol), ketone (e.g., acetone, methyl ethyl ketone), dimethylformamide, dimethylsulfoxide, and methyl cellosolve.

An emulsion dispersion method which is well known in the art can be used to dissolve the redox compound in an oil such as dibutyl phthalate, tricresyl phosphate and glyceryl triacetate or auxiliary solvent such as ethyl acetate and diethyl phthalate to mechanically prepare an emulsion dispersion. Alternatively, a method known as the solid dispersion method can be used to disperse redox compound grains in water by means of a ball mill or colloid mill or by an ultrasonic apparatus.

The layer containing the redox compound of the present invention may be provided on or under the light-sensitive emulsion layer containing the hydrazine derivative. The layer containing the redox compound may further contain light-sensitive or light-insensitive silver halide emulsion grains. Between the layer containing the redox compound and the light-sensitive emulsion layer containing the hydrazine derivative may be provided an interlayer containing gelatin or a synthetic polymer (e.g., polyvinyl acetate, polyvinyl alcohol).

The emulsion to be used in the light-sensitive silver halide emulsion layer containing the hydrazine derivative is a monodispersed silver halide emulsion comprising any of silver chloride, silver bromochloride, silver iodochloride and silver bromoiodochloride, having a silver chloride content of 50 mol% or more, preferably 70 mol% or more and a silver iodide content of 3 mol% or less, more preferably 0.5 mol% or less.

The average grain size of silver halide is preferably in the range of finely divided grains (e.g., 0.7 μm or less), more preferably 0.5 μm or less, most preferably 0.1 to 0.4 μm. the term "monodispersed emulsion" as used herein means an emulsion of grains, at least 95% by weight or number of grains of which fall within the average grain size of about ±40%".

The preparation of the monodispersed silver halide emulsion to be used in the present invention can be accomplished by various known methods known in the field of silver halide photographic materials. Examples of these methods include those described in P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodispersed emulsion to be used in the present invention is a silver halide emulsion preferably having a grain size distribution coefficient (hereafter referred to as "coefficient of variation") of 20% or less, preferably 15% or less.

The coefficient of variation is defined as follows:

$$\text{Coefficient of variation (\%)} = \frac{\text{Standard deviation of grain diameter}}{\text{Average value of grain diameter}} \times 100$$

The reaction of water-soluble silver salts (e.g., an aqueous solution of silver nitrate) and water-soluble halides can be carried out by any of a single jet process, a double jet process, a combination thereof, and the like. As one of the double jet processes, a method can be used in which the pAg value of a liquid phase where silver halide grains are formed is maintained at a constant rate, i.e., controlled double jet process may also be used. A silver halide solvent such as ammonia, thioether and 4-substituted thiourea may be preferably used to form grains.

Preferred among these silver halide solvents are 4-substituted thiourea compounds. These 4-substituted thiourea compounds are described in JP-A-53-82408 and 55-77737. Preferred examples of such thiourea compounds include tetramethylthiourea, and 1,3-dimethyl-2-imidazolidinethione.

The controlled double jet process and the grain formation process using a silver halide solvent provide for an easy preparation of a silver halide emulsion containing grains having a regular crystal form and a narrow grain size distribution and thus are effective methods for the preparation of an emulsion which can be used in the present invention.

The monodispersed emulsion grains preferably have a regular crystal from such as cubic, octahedron and tetradecahedron, preferably cubic.

The silver halide grains may comprise a phase in which the composition in uniform, or differes from the internal layer to the surface layer.

During silver halide grain formation or physical ripening, a cadmium salt, a sulfite, a lead salt, a thallium salt, a rhodium salt or a complex thereof, or an iridium salt or a complex thereof may be present in the system.

In the present invention, a silver halide emulsion particularly suitable for photographing of line originals and dot formation is an emulsion which has been prepared in the presence of an iridium salt or complex thereof in an amount of $1\times10^{-8}$ mol to $1\times10^{-5}$ mole per mol of silver.

In the foregoing description, an iridium salt may be preferably added to the system before the physical ripening, particularly during the formation of grains in the process for the preparation of silver halide grains in the above mentioned amount.

As an iridium salt, a water-soluble iridium salt or iridium complex can be used. Examples of such an iridium salt include iridium trichloride, iridium tetrachloride, potassium hexachloroidiumate (III), potassium hexachloroiridiumate (IV), and ammonium hexachloroiridiumate (III).

The monodispersed emulsion of the present invention may be preferably subject to chemical ripening. The chemical sensitization can be accomomplished by known methods such as sulfur sensitization, reduction sensitization and gold sensitization, singly or in combination. Preferred among these chemical sensitization methods is gold-sulfur sensitization.

As sulfur sensitizing agents, sulfur compounds contained in gelatin as well as various sulfur compound such as thiosulfates, thioureas, thiazoles and rhodanines can be used. Specific examples of these sulfur compounds include those disclosed in U.S. Pat. Nos. 1,574,944, 2,278,947, 2,410,689, 2,728,668, 3,501,313, and 3,656,955. Preferred among these sulfur compounds are thiosulfates and thiourea compounds. The chemical sensitization may be preferably effected at a pAg value of 8.3 or less, more preferably 7.3 to 8.0. Furthermore, a method as reported in Moisar, "Klein Gelatine", Proc. Syme., 2nd, pp. 301-309 (1970) which comprises the combined use of polyvinyl pyrrolidone and thiosulfate can provide excellent results.

The gold sensitization is a typical noble metal sensitization method. The gold sensitization employes a gold compound, mainly gold complex. Such a gold compound may contain complexes of noble metals other than gold, e.g., platinum, palladium and iridium. Specific examples of these complexes are described in U.S. Pat. No. 2,448,060 and British Patent 618,061.

As reduction sensitizing agents, stannous salts, amines, formamidinesulfinic acids, and silane compounds can be used.

As a suitable binder or protective colloid for the photographic emulsion, gelatin may be advantageously used. Other hydrophilic colloids may be used. Examples of such hydrophilic colloids include gelatin derivatives; a graft polymer of gelatin with other high molecular weight compounds; protein such as albumin, and casein; cellulose derivatives such as hydroxyethyl cellulose, carboxymethyl cellulose, cellulose ester sulfate; saccharide derivative such as sodium alginate, dextran and starch derivatives; mono-polymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other synthetic hydrophilic high molecular weight compounds.

Also, lime-treated gelatin, acid-treated gelatin, enzyme-treated gelatin may be used.

In the present invention, a sensitizing dye which exhibits a maximum absorption in the visible range as disclosed on pages 45 to 53 of JP-A-55-52050 (e.g., cyanine dye, melocyanine dye) may be incorporated in the system. Thus, spectral sensitization can be effected in a wavelength range longer than the inherent sensitivity range of silver halide.

These sensitizing dyes can be used singly or in combination. Such a combination of sensitizing dyes is often used particularly for the purpose of supersensitization. The present emulsion may contain, in combination with such a sensitizing dye, a substance which does not exhibit a spectral sensitization effect itself or a substance which does not substantially absorb the visible light but which exhibit a supersensitization effect when used in combination.

Useful sensitizing dyes and combinations of substances exhibiting a supersensitization effect are described in *Research Disclosure* No. 17643, Vol. 176, December, 1978.

In one embodiment of the present invention, a compound of formula (III) substantially having no maximum absorption in the visible range may be advantageously incorporated in at least one of the silver halide emulsion layers or other hydrophilic colloidal layers to accomplish the objects of the present invention:

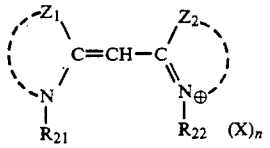

wherein $Z_1$ and $Z_2$ each represents a nonmetallic atom group required to form benzoxazole nucleus, benzothiazole nucleus, benzoselenazole nucleus, naphthoxazole nucleus, naphthothiazole nucleus, naphthoselenazole nucleus, thiazole nucleus, thiazoline nucleus, oxazole nucleus, selenazole nucleus, selenazoline nucleus, pyridine nucleus, benzimidazole nucleus or quinoline nucleus; $R_{21}$ and $R_{22}$ each represents an alkyl group or aralkyl group; X represents a charge-balanced paired ion; and n represents an integer 0 or 1.

The compound of formula (III) substantially having no maximum absorption in the visible range will be further described hereinafter.

If the compound of formula (III) is a radical group, it is preferably a group obtained by releasing one hydrogen atom from the atomic group represented by $Z_1$ or $Z_2$ or the group represented by $R_{21}$ or $R_{22}$, preferably from $R_{22}$.

In formula (III), if the substituents contain acid groups (e.g., if $R_{21}$ and $R_{22}$ each contains an alkyl or aralkyl group containing an acid group), the substituents thereselves may be a compound of formula (III).

In formula (III), the heterocyclic group formed of $Z_1$ or $Z_2$ is preferably a benzoxazole nucleus, benzothiazole nucleus, naphthoxazole nucleus, naphthothiazole nucleus, thiazole nucleus or oxazole nucleus, more preferably benzoxazole nucleus, benzothiazole nucleus or naphthoxazole nucleus, most preferably benzoxazole nucleus or naphthoxazole nucleus.

In formula (III), the heterocyclic group formed of $Z_1$ or $Z_2$ may be substituted by at least one substituent. Examples of such a substituent include halogen atoms (e.g., fluorine, chlorine, bromine, iodine), nitro groups, alkyl groups (preferably $C_{1-4}$ alkyl groups, e.g., methyl, ethyl, trifluoromethyl, benzyl, phenethyl), aryl groups (e.g., phenyl), alkoxy groups (preferably $C_{1-4}$ alkoxy groups, e.g., methoxy, ethoxy, propoxy, butoxy), carboxyl groups, alkoxycarbonyl groups (preferably $C_{2-5}$ alkoxycarbonyl groups, e.g., ethoxycarbonyl), hydroxyl groups, and cyano groups.

In formula (III), examples of the benzothiazole nucleus formed of $Z_1$ or $Z_2$ include benzothiazole, 5-chlorobenzothiazole, 5-nitrobenzothiazole, 5-methylbenzothiazole, 6-bromobenzothiazole, 5-iodobenzothiazole, 5-phenylbenzothiazole, 5-methoxybenzothiazole, 6-methoxybenzothiazole, 5-carboxybenzothiazole, 5-ethoxycarbonylbenzothiazole, 5-fluorobenzothiazole, 5-chloro-6-methylbenzothiazole, and 5-trifluoromethylbenzothiazole.

Examples of the naphthothiazole nucleus formed of $Z_1$ or $Z_2$ include naphtho[1,2-d]thiazole, naphtho[2,1-d]thiazole, naphtho[2,3-d]thiazole, 5-methoxynaphtho[1,2-d]-thiazole, and 5-methoxynaphtho[2,3-d]thiazole.

Examples of the benzoselenazole nucleus formed of $Z_1$ or $Z_2$ include benzoselenazole, 5-chlorobenzoselenazole, 5methoxybenzoselenazole, 5-hydroxybenzoselenazole, and 5-chloro-6-methylbenzoselenazole.

Examples of the naphthoselenazole nucleus formed of $Z_1$ or $Z_2$ include naphtho[1,2-d]selenazole, and naphtho[2,1-d]selenazole.

Examples of the thiazole nucleus formed of $Z_1$ or $Z_2$ include thiazole nucleus, 4-methylthiazole nucleus, 4-phenylthiazole nucleus, and 4,5-dimethylthiazole nucleus.

Examples of the thiazoline nucleus formed of $Z_1$ or $Z_2$ include thiazoline nucleus, and 4-methylthiazoline nucleus.

In formula (III), examples of the benzoxazole nucleus formed of $Z_1$ or $Z_2$ include benzoxazole nucleus, 5-chlorobenzoxazole nucleus, 5-methylbenzoxazole nucleus, 5-bromobenzoxazole nucleus, 5-fluorobenzoxazole nucleus, 5-phenylbenzoxazole nucleus, 5-methoxybenzoxazole nucleus, 5-ethoxybenzoxazole nucleus, 5-trifluoromethylbenzoxazole nucleus, 5-hydroxybenzoxazole nucleus, 5-carboxybenzoxazole nucleus, 6-methylbenzoxazole nucleus, 6-chlorobenzoxazole nucleus, 6-methoxybenzoxazole nucleus, 6-hydroxybenzoxazole nucleus, and 5,6-dimethylbenzoxazole nucleus.

Examples of the naphthoxazole nucleus formed of $Z_1$ or $Z_2$ include naphto[2,1-d]oxazole nucleus, naphtho[1,2-d]oxazole nucleus, naphtho[2,3-d]oxazole nucleus, and 5-methoxynaphtho-[1,2-d]oxazole nucleus.

Examples of the oxazole nucleus formed of $Z_1$ or $Z_2$ include oxazole nucleus, 4-methyloxazole nucleus, 4-phenyloxazole nucleus, 4-methoxyoxazole nucleus, 4,5-dimethyloxazole nucleus, 4,5-dimethyloxazole nucleus, 5-phenyloxazole nucleus, and 4-methoxyoxazole nucleus.

Examples of the pyridine nucleus formed of $Z_1$ or $Z_2$ include 2-pyridine nucleus, 4-pyridine nucleus, 5-methyl-2-pyridine nucleus, and 3-methyl-4-pyridine nucleus.

Examples of the quinoline nucleus formed of $Z_1$ or $Z_2$ include 2-quinoline nucleus, 4-quinoline nucleus, 3-methyl-2-quinoline nucleus, 5-ethyl-2-quinoline nucleus, 8-fluoro-2-quinoline nucleus, 6-methoxy-2-quinoline nucleus, 8-chloro-4-quinoline nucleus, and 8-methyl-4-quinoline nucleus.

In formula (III), the alkyl group represented by $R_{21}$ or $R_{22}$ may be a substituted or unsubstituted alkyl group. The unsubstituted alkyl group contains 18 or less carbon atoms, preferably 8 or less carbon atoms. Examples of such an unsubstituted alkyl group include methyl group, ethyl group, n-propyl group, n-butyl group, n-hexyl group, and n-octadecyl group.

In the substituted alkyl group, the alkyl portion preferably contains 6 or less carbon atoms, particularly 4 or less carbon atoms. Examples of such a substituted alkyl group include sulfo-substituted alkyl groups (the sulfo group may be bonded to the alkyl group via an alkoxy group or aryl group; e.g., 2-sulfoethyl, 3-sulfopropyl, 3-sulfobutyl, 4-sulfobutyl, 2-(3-sulfopropoxy)ethyl, 2-[2-(3-sulfopropoxy)ethoxy]ethyl, 2-hydroxy-3-sulfopropyl, p-sulfophenethyl, p-sulfophenylpropyl), carboxy-substituted alkyl group (the carboxy group may be bonded to the alkyl group via an alkoxy group or aryl group; e.g., carboxymethyl, 2-carboxyethyl, 3-carboxypropyl, 4-carboxybutyl), hydroxyalkyl group (e.g., 2-hydroxyethyl, 3-hydroxypropyl), acyloxyalkyl group (e.g., 2-acetoxyethyl, 3-acetoxypropyl), alkoxyalkyl group (e.g., 2-methoxyethyl, 3-methoxypropyl), alkoxycarbonylalkyl group (e.g., 2-methoxycarbonylethyl, 3-methoxycarbonylpropyl, 4-ethoxycarbonylbutyl), vinyl-substituted alkyl group (e.g., allyl), cyanoalkyl group (e.g., 2-cyanoethyl), carbamoylalkyl group (e.g., 2-carbamoylethyl), aryloxyalkyl group (e.g., 2-phenoxyethyl, 3-phenoxypropyl), aralkyl group (e.g., 2-phenethyl, 3-phenylpropyl), and aryloxyalkyl group (e.g., 2-phenoxyethyl, 3-phenoxypropyl).

In particular, at least one of the substituents represented by $R_{21}$ and $R_{22}$ is preferably an alkyl group containing a sulfo group or carboxyl group.

The charge-balanced paired ion represented by X is an anion capable of countering positive charges produced by quaternary ammonium salt in the heterocyclic group. Examples of such an anion include bromine ion, chlorine ion, iodine ion, p-toluenesulfonic acid ion, ethylsulfonic acid ion, perchloric acid ion, trifluoromethanesulfonic acid ion, and thiocyan ion. In this case, n is 1.

If the heterocyclic quaternary ammonium salt contains an anionic substituent such as a sulfoalkyl substituent, it may be in the form of bentaine. In this case, no paired ions are needed, and n is 0. If the heterocyclic quaternary ammonium salt contains two anionic substituents such as two sulfoalkyl groups, X is an anionic paired ion. Examples of such an anionic paired ion include alkaline metal ions (e.g., sodium ion, potassium ion), and ammonium salts (e.g., triethylammonium).

The term "compound substantially having no maximum absorption in the visible light range" as used herein means a compound having a color tone of a level which has no practical problem with respect to residual color on the photographic light-sensitive material, particularly after development.

Such a compound preferably exhibits a maximum adsorption of 460 nm or lower, more preferably 430 nm or lower, in methanol.

Specific examples of the compound represented by formula (III) will be set forth below, but the present invention should not be construed as being limited thereto.

III-1

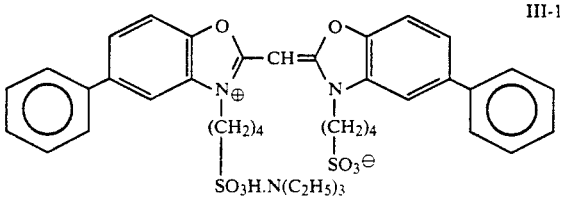

III-2

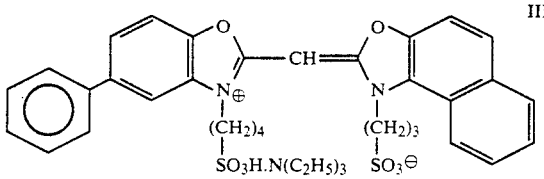

III-3

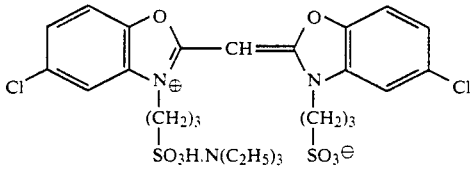

III-4

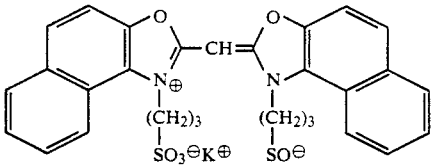

III-5

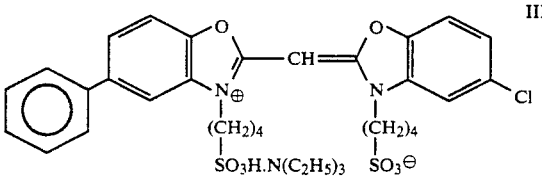

III-6

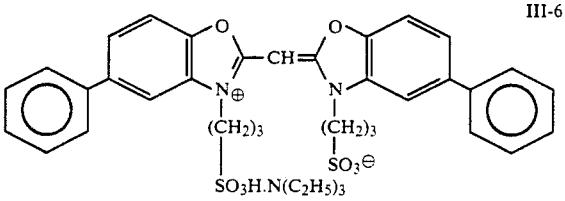

-continued

III-7

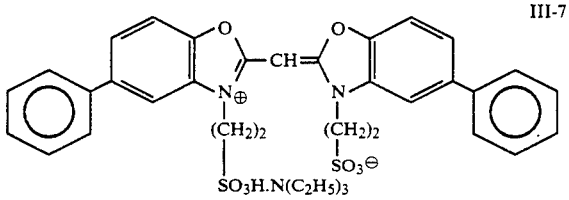

III-8

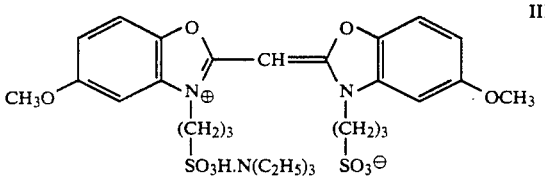

III-9

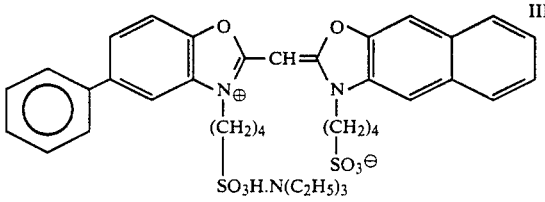

III-10

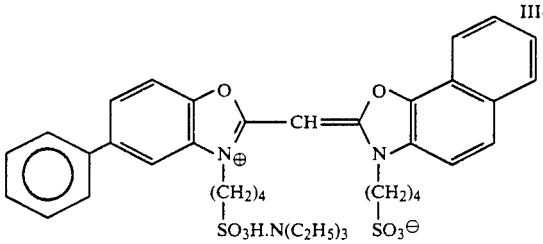

III-11

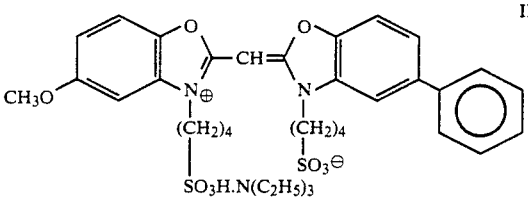

III-12

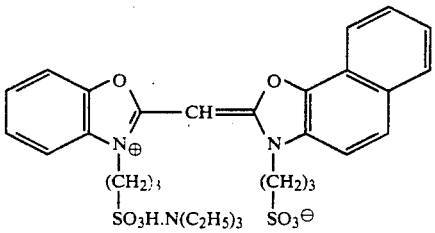

III-13

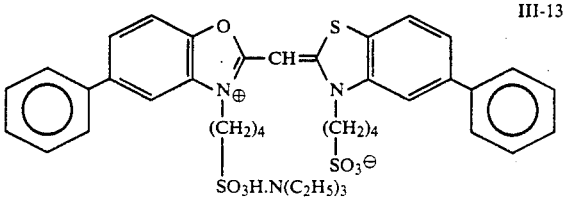

-continued

III-14

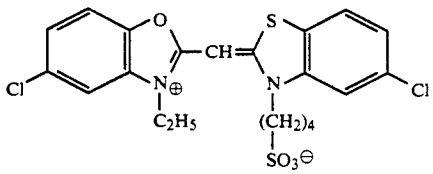

III-15

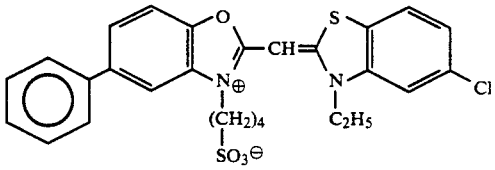

III-16

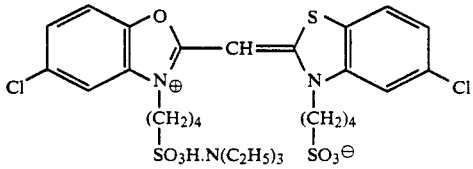

III-17

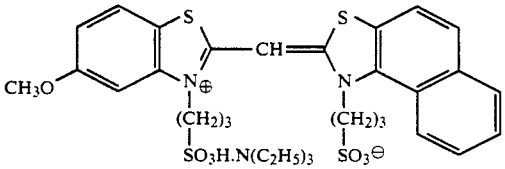

III-18

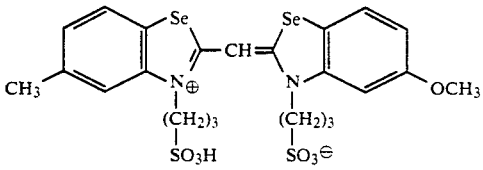

III-19

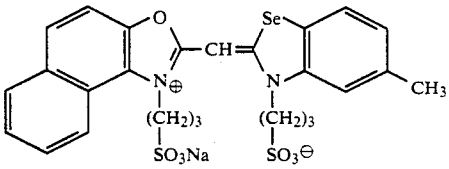

III-20

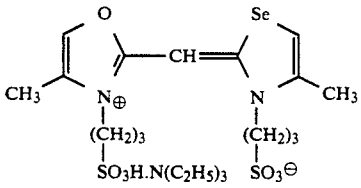

III-21

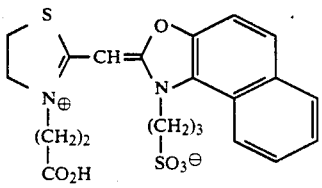

-continued

III-22

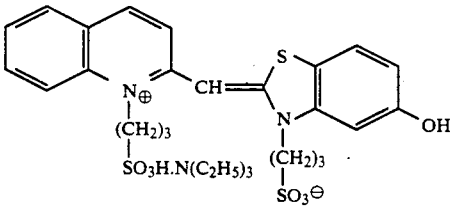

III-23

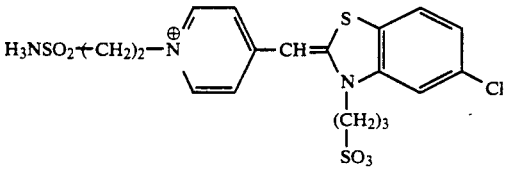

III-24

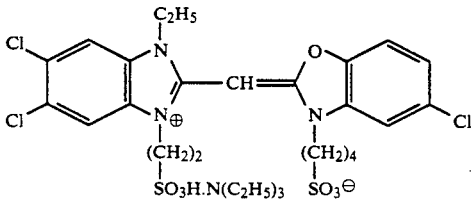

III-25

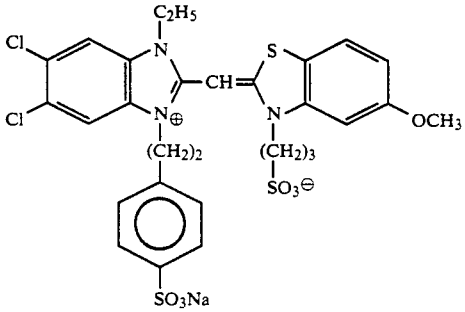

III-26

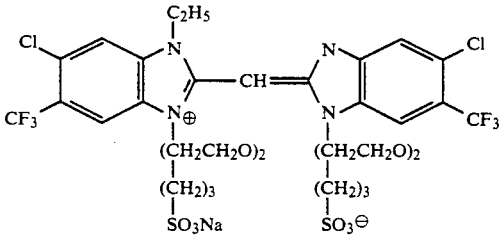

The optimum amount of the compound of formula (III) to be incorporated in the system can be selected depending on the grain diameter, halogen composition, process and degree of chemical sensitization of the silver halide emulsion, the relationship between the layer in which the compound is incorporated and the silver halide emulsion layer, and the type of fog inhibitors used. Test methods for the selection of the optimum value are well known by those skilled in the art. The optimum value is preferably in the range of $1\times10^{-6}$ mol to $1\times10^{-2}$ mol, preferably $1\times10^{-5}$ to $5\times10^{-3}$ mol per mol of silver halide.

The present emulsion layer or other hydrophilic colloidal layers may contain a water-soluble dye as a filter dye or for the purpose of inhibiting irradiation or other related purposes.

As such a filter dye, a dye for further lowering photographic sensitivity can be used, preferably an ultraviolet absorber having a maximum spectral absorption in the inherent sensitivity range of silver halide or a dye having a substantial light absorption mainly in the wavelength range of 350 nm to 600 nm for enhancing the safety to safelight when the light-sensitive material is processed as daylight light-sensitive material.

These dyes may be preferably incorporated and fixed in the emulsion layer or in the portion above the silver halide emulsion layer, i.e., light-insensitive hydrophilic colloidal layer farther from the support than the silver halide emulsion layer, together with a mordant depending on the purpose of application.

The amount of such a dye to be incorporated in the system depends on the molar absorptivity thereof and is normally in the range of $1\times10^{-2}$ g/m$^2$ to $1\times10^{-2}$ g/m$^2$, preferably $5\times10^{-2}$ g/m$^2$ to 0.5 g/m$^2$.

Specific examples of such a dye are further described in Japanese Patent Application No. 61-209169. Some of these examples will be set forth below.

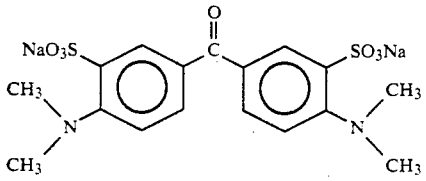

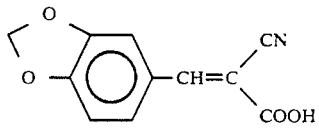

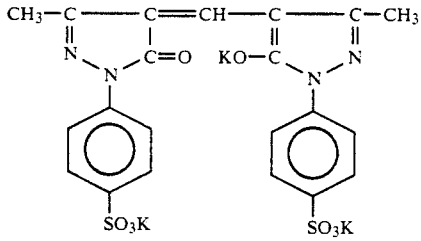

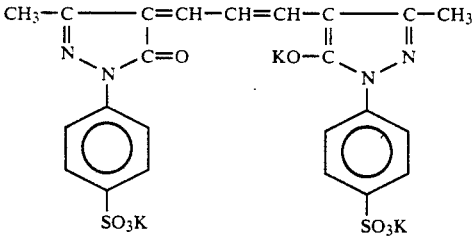

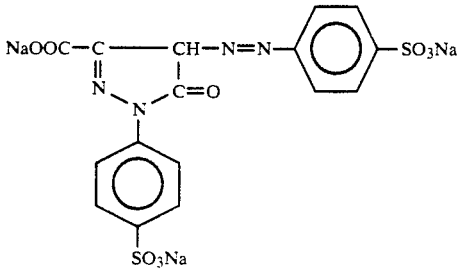

-continued

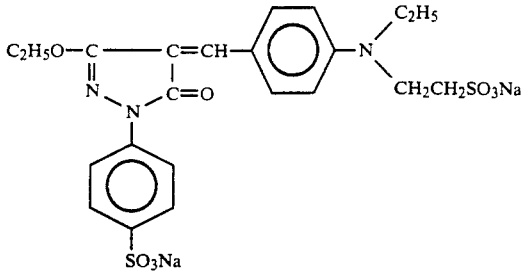

These dyes may be incorporated in the coating solution for a light-insensitive hydrophilic colloidal layer in the form of solution in a suitable solvent such as water, alcohol (e.g., methanol, ethanol, propanol), acetone, methylcellosolve and mixture thereof.

Two or more of these dyes can be used in combination.

The dye can be used in an amount required to enable processing in the daylight. Specifically, the optimum amount of the dye to be used is normally in the range of $1\times10^{-3}$ g/m$^2$ to 1 g/m$^2$, preferably $1\times10^{-3}$ g/m$^2$ to 0.5 g/m$^2$.

The light-sensitive material may comprise various compounds for the purpose of inhibiting fog during the preparation, preservation or photographic processing of the light-sensitive material or stabilizing the photographic properties thereof. Examples of such compounds which may be incorporated in the light-sensitive material include many compounds known as fog inhibitors or stabilizers, such as azoles, e.g., benzothiazolium salt, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles, nitrobenzotriazoles, mercaptopyrimidines, mercaptotriazines, thioketo compounds, e.g., oxazolinethione, azaindenes, e.g., triazaindenes, tetrazaindenes (particularly 4-hydroxysubstituted (1,3,3a,7)tetraazaindenes), pentaazaindenes, benzenesulfonic acid, benzenesulfinic acid, and benzenesulfonic acid amide. Preferred among these compounds are benzotriazoles (e.g., 5-methyl-benzotriazole), and nitroindazoles (e.g., 5-nitroindazole). These compounds may be incorporated in processing solutions.

A compound which releases a development inhibitor during development as disclosed in JP-A-62-30243 can be incorporated in the system as stabilizer or for the purpose of inhibiting black pepper.

The photographic light-sensitive material can comprise developing agents such as hydroquinone derivatives and phenidone derivatives as stabilizers, accelerators or for other related purposes.

The photographic emulsion layers or other hydrophilic colloid layers in the present photographic light-sensitive material may comprise an inorganic or organic film hardener such as chromium salts (e.g., chrome alum, chromium acetate), aldehydes (e.g., formaldehyde, glutaraldehyde), N-methylol compounds (e.g., dimethylol urea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), and mucohalogenic acids (e.g., mucochloric acid), singly or in combination.

The photographic emulsion layers or other hydrophilic colloid layers in the light-sensitive material may comprise any type of surface active agents for the purpose of facilitating coating and emulsion dispersion, inhibiting electric charging and adhesion, improving smoothness and photographic properties (e.g., acceleration of development, higher contrast, sensitization) or similar purposes.

Examples of such surface active agents include nonionic surface active agents such as saponin (steroid series), alkylene oxide derivatives (e.g., polyethylene glycol, polyethylene glycol/polypropylene glycol condensate, polyethylene glycol alkyl ether or polyethylene glycol alkylaryl ether, polyethylene glycol ester, polyethylene glycol sorbitan ester, polyalkylene glycol alkylamine or amide, polyethylene oxide addition product of silicone), glycidol derivatives (e.g., polyglyceride alkenylsuccinate, alkylphenol polyglyceride), alkyl esters (e.g., aliphatic esters of polyhydric alcohol), anionic surface active agents containing acid groups such as carboxyl group, sulfo group, phospho group, ester sulfate group or ester phosphate group (e.g., alkylcarboxylate, alkylsulfonate, alkylbenzenesulfonate, alkylnaphthalenesulfonate, alkylsulfuric ester, alkylphosphoric ester, N-acyl-N-alkyltaurine, sulfosuccinic ester, sulfoalkyl polyoxyethylene alkyphenyl ether, polyoxyethylene alkylphosphoric ester), amphoteric surface active agents such as amino acid, aminoalkylsulfonic acid, aminoalkylsulfuric or phosphoric ester, alkylbetaine and amine oxide, and cationic surface active agents such as alkylamine salt, aliphatic or aromatic quaternary ammonium salt, heterocyclic quaternary ammonium salt (e.g., pyridinium, imidazolium), and aliphatic or heterocyclic group-containing phosphonium or sulfonium salt.

One surface active agents which can be preferably used in the present invention is a polyalkylene oxide having a molecular weight of 600 or more as disclosed in JP-B-58-9412 (the term "JP-B" as used herein means an "examined Japanese Patent Publication").

In order to inhibit electric charging, a fluorine-containing surface active agent as disclosed in JP-A-60-80849 may be preferably used.

The photographic emulsion layers or other hydrophilic colloidal layers in the present photographic light-sensitive material may comprise a hydroquinone derivative which releases a development inhibitor (i.e., so-called DIR-hydroquinone) in correspondence to the density of images during development.

Specific examples of such DIR-hydroquinones include those disclosed in U.S. Pat. Nos. 3,379,529, 3,620,746, 4,377,634, and 4,332,878, and JP-A-49-129536, 54-67419, 56-153336, 56-153342, 59-278853, 59-90435, 59-90436, and 59-138808.

The silver halide emulsion layers or other hydrophilic colloidal layers in the present photographic light-sensitive material may comprise matting agents such as silica, magnesium oxide and polymethyl methacrylate for the purpose of inhibiting adhesion.

The silver halide emulsion layers or other hydrophilic colloidal layers of the photographic light-sensitive material may comprise a dispersion of a synthetic polymer which has poor solubility or is insoluble in water for the purpose of improving dimensional stability. Examples of such a synthetic polymerincludealkyl(meth)acrylate,alkoxyalkyl(meth)acrylate, glycidyl(meth)acrylate, singly or in combination, and polymers comprising, as monomer components, combinations of these compounds with acrylic acid, methacrylic acid, or the like.

Examples of effective development accelerators or nucleation infectious development accelerators suitable for use in the present invention include compounds as disclosed in JP-A-53-77616, 54-37732, 53-137133, 60-140340, and 60-14959, and various compounds containing a nitrogen or sulfur atom.

Specific examples of suitable accelerators will be set forth below.

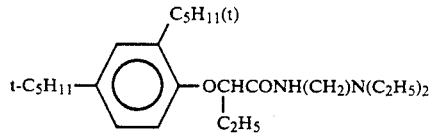

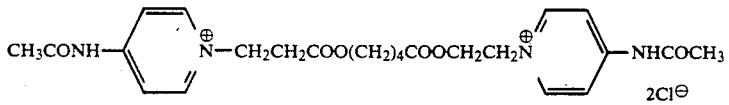

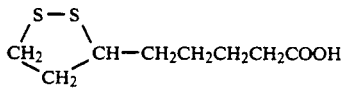

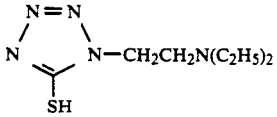

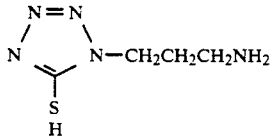

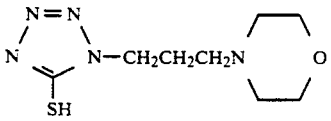

-continued

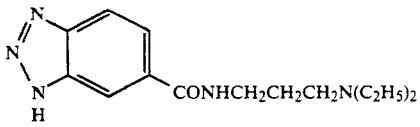

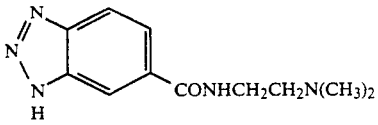

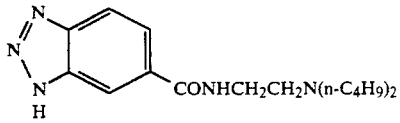

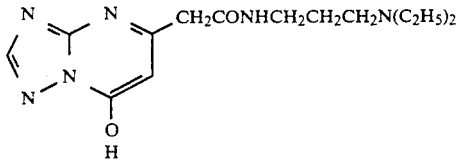

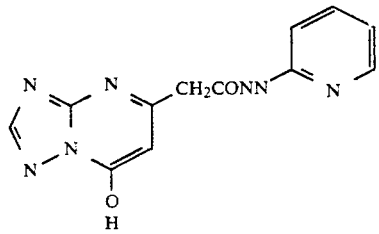

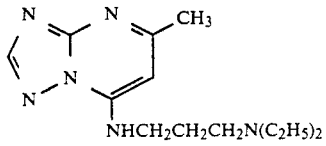

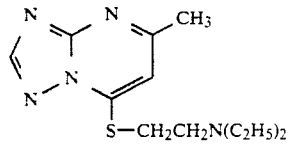

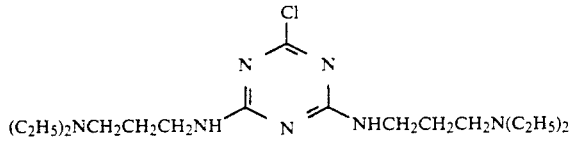

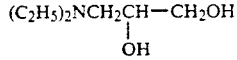

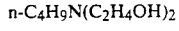

The optimum amount of such an accelerator to be incroporated in the system depends on its type and is normally in the range of $1.0\times10^{-3}$ g/m$^2$ to 0.5 g/m$^2$, preferably $5.0\times10^{-3}$ g/m$^2$ to 0.1 g/m$^2$.

The silver halide emulsion layers and other layers in the photographic light-sensitive material may comprise a compound containing an acid group. Examples of such a compound containing an acid group include organic acid such as salicylic acid, acetic acid and ascorbic acid and polymers or copolymers containing, as repeating units, acid monomers such as acrylic acid, maleic acid and phthalic acid. For these compounds, reference can be made to JP-A-61-223834, 61-228437, 62-25745 and 62-55642. Particularly preferred among these compounds are ascorbic acid as a low molecular weight compound and a water-dispersible latex of a copolymer comprising an acid monomer such as acrylic acid and a crosslinkable monomer containing two or more unsaturated groups such as divinylbenzene.

Suitable supports include glass, cellulose acetate film, polyethylene terephthalate film, paper, baryta-coated paper and polyolefin-coated paper.

One of the preferred embodiments of the present invention is a silver halide photographic material which comprises on the same surface of a support:

a. a first light-sensitive silver halide emulsion layer comprising a monodispersed emulsion having a silver chloride content of 50 mol % or more, and containing a hydrazine derivative; and b. a second light-sensitive silver halide emulsion layer, wherein the second light-sensitive silver halide emulsion layer or another hydrophilic colloidal layer provided on the same surface of the support contains a redox compound capable of releasing a development inhibitor upon oxidation.

In particular, the percent swelling of the silver halide photographic material on the side of the support having the light-sensitive silver halide emulsion layers and other hydrophilic colloidal layers is preferably in the range of 100 to 200% more preferably 120 to 170%, whereby a light-sensitive material for plate making which exhibits a wide dot gradation and very little black pepper can be obtained .

The total gelatin content of the silver halide photographic material on the side of the support having the light-sensitive silver halide emulsion layers and other hydrophilic colloidal layers may be preferably in the range of 7 g/m$^2$ or less, more preferably 5.5 g/m$^2$ or less.

If the percent swelling of the silver halide photographic material is less than 100%, the silver halide photographic material may become susceptible to black pepper. On the other hand, if the percent swelling of the silver halide photographic material exceeds 200%, the light-sensitive material tends to exhibit a narrow dot gradation, deteriorating picture quality.

In the present invention, the "percent swelling" can be determined by the following steps a), b) and c):

a) The thickness of all hydrophilic colloidal layers (e.g., silver halide emulsion layer, surface protective layer, interlayers) in the silver halide photographic material is measured.

b) The silver halide photographic material is dipped in distilled water at a temperature of 25° C. for 1 minute.

c) The percentage of increase in the thickness of all hydrographilic colloidal layers from the initial value is determined.

Accordingly, the "percent swelling" of the hydrophilic colloidal layers as defined herein is represented by the percentage of the increase to the total thickness of all hydrophilic colloidal layers present on the silver halide emulsion layer side of the support before being dipped in distilled water at a temperature of 25° C.

As mentioned above, gelatin can advantageously be used as a hydrophilic colloid binder to be incorporated in the hydrophilic colloidal layers such as the emulsion layer and the surface protective layer. Other hydrophilic colloids can be used.

The gelatin content of the protective layer is preferably in the range of 0.5 g/m$^2$ to 2.0 g/m$^2$.

In the present invention, specific examples of the method for controlling the percent swelling of the hydrophilic colloidal layers including silver halide emulsion layer and light-insensitive layers, include the use of one or more various organic or inorganic gelatin hardeners. Typical examples of such a gelatin hardener include gelatin hardeners well known in the art, such as mucochloric acid, aldehyde compound (e.g., formaldehyde, glutaraldehyde), active vinyl compound (e.g., divinylsulfone, methylenebismaleimide, 1,3,5-triacrylyl-hexahydro-s-triazine, 1,3,5-trivinylsulfonylhexahydro-s-triazine, bis(vinylsulfonylmethyl)ether, 1,3-bis(vinylsulfonyl)-propanol-2, bis(α-vinylsulfonylacetamide)ethane, 1,2-bis(vinylsulfonyl)ethane and 1,1,-bis(vinylsulfonyl)methane, and active halogen compound (e.g., 2,4-dichloro-6-hydroxy-s-triazine). Furthermore, high molecular weight film hardeners as disclosed in JP-A-56-66841, British Patent 1,322,971, and U.S. Pat. No. 3,671,256 can be used.

The optimum amount of the gelatin hardener to be incorporated in the system is preferably selected depending on the type of hardener and gelatin and is preferably in the range of $0.5\times10^{-3}$ mol to $50\times10^{-1}$ mol, more preferably $2\times10^{-3}$ mol to $20\times10^{-3}$ mol, per 100 g of gelatin.

The formulation of the second light-sensitive silver halide emulsion mentioned above may be any of silver halide, e.g., silver chloride, silver bromochloride, silver bromoiodide and silver bromoiodochloride.

The average grain size of the grains in the second light-sensitive silver halide emulsion is preferably in the range of finely divided grain (e.g., 0.7 μm or less), preferably 0.5 μm or less. The grain size distribution of the second light-sensitive silver is not specifically limited but is preferably monodispersed.

The light-sensitive silver halide grains in the second emulsion mentioned above may have a regular crystal form such as cubic and octahedron, an irregular crystal form such as spheric and tablet or may be a composite thereof.

The second light-sensitive silver halide emulsion may or may not be subjected to chemical sensitization. As a method for the chemical sensitization of silver halide emulsion, a sulfur sensitization process, reduction sensitization process or noble metal sensitization process can be used, singly or in combination. The second light-sensitive silver halide emulsion is preferably free of any spectral sensitizing dyes.

In the case of using the silver halide light-sensitive material of the present invention, conventional infectious developers or high alkalinity developers having a pH value of about 13 as disclosed in U.S. Pat. No. 2,419,975 need not be used to obtain an ultrahigh contrast and a high sensitivity. Thus, any stable developers can be used.

In other words, the silver halide light-sensitive material of the present invention can be processed with a developer containing sulfurous ions as preservative in an amount of 0.15 mol/l or more and having a pH value of 10.5 to 12.3, preferably 11.0 to 12.0 to obtain a negative image with a sufficiently ultrahigh contrast.

The developing agent to be incorporated in the developer to be used in the present invention is not specifically limited. As developing agents, dihydroxybenzenes, which can easily provide an excellent dot quality may preferably be used. A combination of dihydroxybenzenes and 1-phenyl-3-pyrazolidones or a combination of dihydroxybenzenes and p-aminophenols may be used.

Examples of dihydroxybenzene developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Particularly preferred among these compounds is hydroquinone.

Examples of 1-phenyl-3-pyrazolidone or derivatives thereof as developing agent to be used in the present invention include 1-phenyl-3-pyrazolidone, 1-phenyl-4,4-dimethyl-4-pyrazolidone, 1-phenyl-4-methyl-4-hyiroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of p-aminophenolic developing agents to be used in the present invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol. Particularly preferred among these compounds is N-methyl-p-aminophenol.

Such a developing agent may be preferably used in an amount of 0.05 mol/l to 0.8 mol/l. If a combination of dihydroxybenzenes and 1-phenyl-3-pyrazolidones or p-aminophenols is used, the two developing agents may be preferably used in amounts of 0.05 mol/l to 0.5 mol/l and 0.06 mol/l or less, respectively.

Examples of sulfites which can be used as preservative in the present invention include sodium sulfite, potassium sulfite, lithium sulfite, ammonium sulfite, sodium bisulfite, potassium metabisulfite, and formaldehyde sodium bisufite. The amount of such a sulfite to be used is preferably in the range of 0.15 mol/l or more, preferably 0.5 mol/l or more. The upper limit of the amount of such a sulfite to be used is preferably 2.5 mol/l.

Examples of alkaline agents to be used for the adjustment of pH value include pH adjustors and buffers such as sodium hydroxide, potassium hydroxide, sodium carbonate, potassium carbonate, sodium tertiary phosphate, and potassium tertiary phosphate. The pH value of the developer is adjusted to 10.5 to 12.3.

Examples of additives other than the above mentioned components include compounds such as boric acid and borax, development inhibitors such as sodium bromide, potassium bromide and potassium iodide, organic solvents such as ethylene glycol, diethylene glycol, triethylene glycol, dimethylformam.ide, methylcellosolve, hexylene glycol, ethanol and methanol, and fog inhibitors or black pepper inhibitors such as indazole compounds (e.g., 1- phenyl-5-mercaptotetrazole, and 5-nitroindazole), and benztriazole compounds (e.g., 5-methylbenztriazole). The present developer may further optionally contain a toner, a surface active agent, an anti-foaming agent, a water hardener, a film hardener, and an amino compound as disclosed in 56-106244.

The present developer may contain a compound as described in JP-A-56-24347 as a silver stain inhibitor. As a solution aid to be incorporated in the developer, a compound as described in Japanese Patent Application No. 60-109743 can be used. As a pH buffer to be incorporated in the developer, a compound as described in JP-A-60-93433 or 62-186259 can be used.

As described in U.S. Pat. No. 4,269,929, amines can be incorporated in the developer to improve the development speed, the reducing the development time.

As a fixing agent, compounds a commonly used and known in the art can be used. Examples of such fixing agents are thiosufates and thiocyanates as well as organic sulfur compounds which are known to serve as fixing agents. The fixing solution may contain, as a film hardener, a water-soluble aluminum (e.g., aluminum sulfate, alum). The amount of the water-soluble aluminum salt to be used is normally in the range of 0.4 g/l to 2.0 g/l as calculated in terms of aluminum. The fixing solution may further contain a trivalent iron compound as an oxidizer in the form of a complex thereof with ethylenediaminetetraacetic acid.

The development temperature is normally in the range of 18° C. to 50° C., preferably 25° C. to 43° C..

In the present photographic processing, an automatic developing machine is preferably used. In the present processing process, even if the total processing time between the input of the light-sensitive material into the automatic developing machine and the output thereof from the automatic developing machine is set between 90 seconds and 120 seconds, a sufficiently ultrahigh contrast negative gradation can be obtained.

The present invention will be further described in the following examples, but the present invention should not be construed as being limited thereto.

EXAMPLE 1

Emulsion A

A 0.13 M aqueous solution of silver nitrate and an aqueous solution of halogen salts containing $(NH_4)_3RhCl_6$ in an amount of $1\times10^{-7}$ mol per mol of silver, 0.04 M potassium bromide and 0.09 M sodium chloride were added to an aqueous solution of gelatin containing sodium chloride with stirring at a temperature of 45° C. for 12 minutes in a double jet process to prepare silver bromochloride grains having an average grain size of 0.15 μm and a silver chloride content of 70 mol %. Thus, nuclei were formed. Then, a 0.87 M aqueous solution of silver nitrate and an aqueous solution of halogen salts containing 0.26 M potassium bromide and 0.65 M sodium chloride were similarly added to the system for 20 minutes in a double jet process.

A solution containing $1\times10^{-3}$ mol of potassium iodide was added to the system to effect conversion. The system was then washed with water by an ordinary flocculation method. 40 g of gelatin were added to the system. The system was then adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. 150 mg of 1,3,3a,7-tetrazaindene were added to the system as a stabilizer. As a result, an emulsion of 'ubhc silver bromochloride grains having an average size of 0.27 μm and a silver chloride content of 70 mol % was obtained (coefficient of variation: 15%).

Emulsion B

A 0.13 M aqueous solution of silver nitrate and an aqueous solution of halogen salts containing $(NH_4)_3RhCl_6$ in an amount of $1\times10^{-7}$ mol per mol of silver, 0.04 M potassium bromide and 0.09 M sodium chloride were added to an aqueous solution of gelatin containing sodium chloride and 1,3-dimethyl-2-imidazolidinethione with stirring at a temperature of 38° C. for 12 minutes in a double jet process to prepare silver bromochloride grains having an average grain size of 0.15 μm and a silver chloride content of 70 mol %. Thus, nuclei were formed. Then, a 0.87 M aqueous solution of silver nitrate and an aqueous solution of halogen salts containing 0.26 M potassium bromide and 0.65 M sodium chloride were similarly added to the system for 20 minutes in a double jet process.

A solution containing $1\times10^{-3}$ mol of potassium iodide was added to the system to effect conversion. The system was then washed with water by an ordinary flocculation method. 40 g of gelatin were added to the system. The system was then adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. 150 mg of 1,3,3a,7-tetraazaindene were added to the system as stabilizer. As a result, an emulsion of cubic silver bromochloride grains having an average size of 0.27 μm and a silver chloride content of 70 mol % was obtained (coefficient of variation: 10%).

Emulsion C

Emulsion C was prepared in the same manner as in Emulsion B except that 1,8-dihydroxy-3,6-dithiaoctane was used as the silver halide solvent instead of 1,3-dimethyl-2-imidazolidinethione (coefficient of variation: 12%).

Emulsion D

A 0.13 M aqueous solution of silver nitrate and an aqueous solution of halogen salts containing $(NH_4)_3RhCl_6$ in an amount of $1\times10^{-7}$ mol per mol of silver, 0.052 M potassium bromide and 0.078 M sodium chloride were added to an aqueous solution of gelatin containing sodium chloride and 1,3-dimethyl-2-imidazolidinethione with stirring at a temperature of 45° C. for 12 minutes in a double jet process to prepare silver bromochloride grains having an average grain size of 0.15 μm and a silver chloride content of 60 mol %. Thus, nuclei were formed. Then, a 0.87 M aqueous solution of silver nitrate and an aqueous solution of halogen salts containing 0.34 M potassium bromide and 0.52 M sodium chloride were similarly added to the system for 20 minutes in a double jet process.

A solution containing $1\times10^{-3}$ mol of potassium iodide was added to the system to effect conversion. The system was then washed with water by an ordinary flocculation method. 40 g of gelatin were added to the system. The system was then adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. 150 mg of 1,3,3a,7-tetraazaindene were added to the system as stabilizer. As a result, an emulsion of cubic silver bromochloride grains having an average size of 0.27 μm and a silver chloride content of 60 mol % was obtained (coefficient of variation: 10%).

Emulsion E:

A 0.13 M aqueous solution of silver nitrate and an aqueous solution of halogen salts containing $(NH_4)_3RhCl_6$ in an amount of $1\times10.$; mol per mol of silver, 0.078 M potassium bromide and 0.052 M sodium chloride were added to an aqueous solution of gelatin containing sodium chloride with stirring at a temperature of 45° C. for 12 minutes in a double jet process to prepare silver bromochloride grains having an average grain size of 0.15 μm and a silver chloride content of 70 mol %. Thus, nuclei were formed. Then, a 0.87 M aqueous solution of silver nitrate and an aqueous solution of halogen salts containing 0.522 M potassium bromide and 0.348 M sodium chloride were similarly added to the system for 20 minutes in a double jet process.

A solution containing $1\times10^{-3}$ mol of potassium iodide was added to the system to effect conversion. The system was then washed with water by an ordinary flocculation method. 40 g of gelatin were added to the system. The system was then adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. 150 mg of 1,3,3a,7-tetraazaindene were added to the system as stabilizer. As a result, an emulsion of cubic silver bromochloride grains having an average size of 0.27 μm and a silver chloride content of 40 mol % was obtained (coefficient of variation: 11%).

Emulsion F

Emulsion F was prepared in the same manner as in Emulsion A except that the agitation conditions were altered to alter the supersaturation degree during the formation of grains (coefficient of variation: 30%).

Emulsion G

Emulsion G was prepared in the same manner as in Emulsion D except that the agitation conditions were altered to alter the supersaturation degree during the formation of grains (coefficient of variation: 25%).

Emulsion H

An aqueous solution containing 1 mol silver nitrate and an aqueous solution of potassium iodide and potassium bromide containing $(NH_4)_3RhCl_6$ in an amount of $1.2\times10^{-7}$ mol per mol of silver were simultaneously added to an aqueous solution of gelatin which had been kept at a temperature of 50° C. in the presence of ammonia for 60 minutes while the pAg value of the system was maintained at 7.8. Thus, a monodisperse emulsion of cubic silver halide grains having an average size of 0.25 μm and an average silver iodide content of 1 mol % was prepared. The emulsion was then desalted by a flocculation method. 40 g of gelatin were added to the emulsion so that the pH value and the pAg value thereof were adjusted to 6.0 and 8.5, respectively. Sodium thiosulfate and chloroauric acid were added to the system in amounts of 5 mg and 6 mg, respectively. The system was then heated to a temperature of 60° C. for 60 minutes so that it was chemically sensitized. 150 mg of 4-hydroxy-6-methyl-1,3,3a,7-tetraazaindene were added to the system as stabilizer (coefficient of variation: 9%).

Emulsions A to H are tabulated in Table 1.

TABLE 1

| Emulsion | Mol % halogen composition Cl | Br | I | Coefficient of variation | Grain size | Crystal habit |
|---|---|---|---|---|---|---|
| A | 69.9 | 30 | 0.1 | 15 | 0.27 μm | Cubic |
| B | " | " | " | 10 | " | " |
| C | " | " | " | 12 | " | " |
| D | 59.9 | 40 | " | 11 | " | " |
| E | 39.9 | 60 | " | 12 | " | " |
| F | 69.9 | 30 | " | 30 | " | " |
| G | 59.9 | 40 | " | 25 | " | " |
| H | — | 99 | 1.0 | 9 | 0.25 | " |

These emulsions were each divided into several lots. 5-[3-(4-sulfobutyl)-5-chloro-2-oxazolidilidene]-1-hydroxyethyl-3-(2-pyridyl) -2-thiohydantoin in an amount of $1\times10^{-3}$ mol per mole of silver, 1-phenyl-5-mercaptotetrazole in an amount of $2\times10^{-4}$ mol per mol of silver, a shortwave cyanine dye represented by the structural by the structural formula (a) in an amount of $5\times10^{-4}$ mol per mol of silver, a water-soluble latex represented by the structural formula in an amount of 200 mg/m², a polyethyl acrylate dispersion in an amount of 200 mg/m², 1,3-divinyl-sulfonyl-2-propanol as film hardener in an amount of 200 mg/m², and a hydrazine compound of the present invention as set forth in Table 2 were added to these lots.

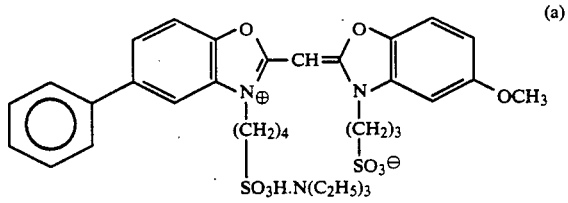

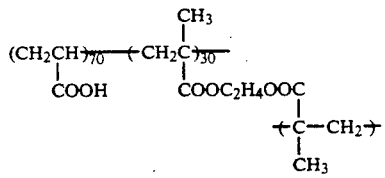

Preparation of emulsion for redox compound-containing layer

Emulsion A': A 1.0 M aqueous solution of silver nitrate and an aqueous solution of halogen salts containing $(NH_4)_3RhCl_6$ in an amount of $3\times10^{-7}$ mol per mol of silver, 0.3 M potassium bromide and 0.74 M sodium chloride were added to an aqueous solution of gelatin containing sodium chloride and 1,3-dimethyl-2-imidazolidinethione with stirring at a temperature of 45° C. for 30 minutes in a double jet process to prepare silver bromochloride grains having an average grain size of 0.28 μm and a silver chloride content of 70 mol %. The system was then washed with water by an ordinary flocculation method. 40 g of gelatin were added to the system so that the system was adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. 150 mg of 4-hydroxy-6-methyl-1,3,3a,7-tetraazaindene were added to the system as stabilizer. As a result, an emulsion of cubic silver bromochloride grains having an average size of 0.28 μm and a silver chloride content of 70 mol % was obtained (coefficient of variation: 10%).

The emulsion was divided into several lots. 5-[3-(4-sulfobutyl)-5-chloro-2-oxazolidilidene]-1-hydroxyethyl-3yl)-2-thiohydantoin in an amount of $1\times10^{-3}$ mol per mol of silver, 1-phenyl-5-mercaptotetrazole in an amount of $2\times10^{-4}$ per mol of silver, a polyethyl acrylate dispersion in an amount of 50 mg/m², 1,2- bis(vinylsulfonylacetamide)ethane in an amount of 40 mg/m², and a redox compound of the present invention as set forth in Table 2 were added to these lots.

A hydrazine-containing layer (Ag content: 3.6 g/m²; gelatin content: 2 g/m²) as lowermost layer, an interlayer (gelatin content: 0.5 g/m²), a redox compound-containing layer (Ag content: 0.4 g/m²; gelatin content: 0.5 g/m²) and a protective layer containing 1.0 g/m² of gelatin, 40 mg of an amorphous $SiO_2$ matting agent having a grain size of about 3.5 μm, 0.1 g/m² of methanol silica, 100 mg/m² of polyacrylamide, 200 mg/m² of hydroquinone, silicone oil and a fluorine surface active agent of the structural formula:

$$C_8F_{17}SO_2\overset{\overset{\displaystyle C_3H_7}{|}}{N}CH_2COOK$$

and sodium dodecylbenzenesulfonate as coating aids were simultaneously coated on a support in this order to prepare samples as set forth in Table 2.

The coating solutions for the back layer and the protective layer therefor were prepared as follows:

| Formulation of back layer | |
|---|---|
| Gelatin | 3 g/m² |
| Latex of polyethyl acrylate | 2 g/m² |
| Surface active agent (sodium p-dodecylbenzenesulfonate) | 40 mg/m² |
| Gelatin hardener | |
| $CH_2{=}CHSO_2CH_2CONH$, $CH_2{=}CHSO_2CH_2CONH$ — $(CH_2)_2$ | 110 mg/m² |
| Dye (mixture of Dye [a], Dye [b] and Dye [c] as shown below) | |
| Dye [a] | 50 mg/m² |

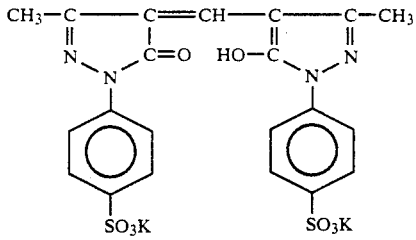

| | |
|---|---|
| Dye [b] | 100 mg/m² |

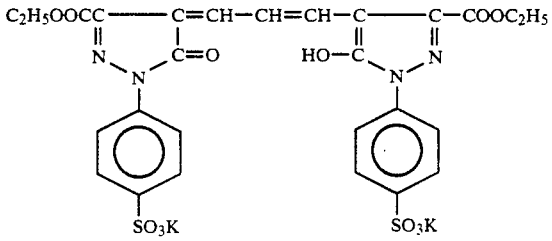

| | |
|---|---|
| Dye [c] | 50 mg/m² |

-continued

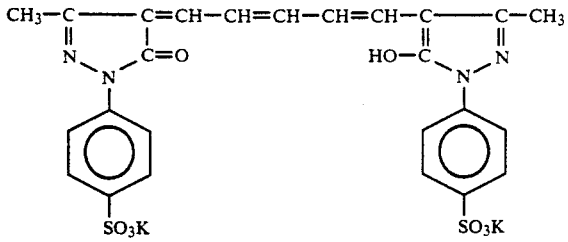

| Formulation of back protective layer | |
|---|---|
| Gelatin | 0.8 g/m$^2$ |
| Finely divided polymethyl methacrylate grains (average grain diameter: 4.5 μm) | 30 mg/m$^2$ |
| Sodium dihexyl-α-sulfosuccinate | 15 mg/m$^2$ |
| Sodium dodecylbenzenesulfonate | 15 mg/m$^2$ |
| Fluorine surface active agent | 5 mg/m$^2$ |
| $C_8F_{17}SO_2N(C_3H_7)-CH_2COOK$ | |
| Finely divided grains of electrically conductive metal oxide ($SnO_2$/Sb = 9:1, 0.22 μm) | 100 mg/m$^2$ |
| Sodium acetate | 40 mg/m$^2$ |

The outline of the layer structure is shown in FIG. 1.

The evaluation of photographic properties was effected by the following test methods.

Photographic properties

Photographic Property 1 is the result of the processing with Developer I having the following formulation at a temperature of 34° C. for 30 seconds in an automatic developing machine FG-660F (available from Fuji Photo Film Co., Ltd).

GR-FI was used as a fixing solution.

| Developer I | |
|---|---|
| Hydroquinone | 50.0 g |
| N-methyl-p-aminophenol | 0.3 g |
| Sodium hydroxide | 18.0 g |
| 5-Sulfosalicylic acid | 30.0 g |
| Boric acid | 20.0 g |
| Potassium sulfite | 110.0 g |
| Disodium ethylenediaminetetracetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole) benzenesulfonate | 0.2 g |
| 6-Dimethylamino-1-hexanol | 4.0 g |
| Sodium toluenesulfonate | 15.0 g |
| Water to make | 1 l |
| pH (adjusted with potassium hydroxide) | 11.7 |

Photographic Property 2 is the result of the processing in the same manner as in Photographic Property 1 except that the developer has been used to process 150 sheets of full large size of 100% blackened Fuji Lith Orthochromatic Film GA-100 (50.8 cm×61 cm).

The value of sensitivity is the reciprocal of the exposure amount giving a density of 1.5 in 34 ° C. with 30 second development relative to that of Sample 1 as 100.

The value of γ is defined as follows:

$$\gamma = \frac{3.0 - 0.3}{\log E_{3.0} - \log E_{0.3}}$$

-continued $E_{3.0}$: exposure amount giving a density of 3.0
$E_{0.3}$: exposure amount giving a density of 0.3

Picture quality

1. Evaluation of quality of enlarged picture

(1) Preparation of original

A transmission image of a person and a step wedge having a stepwise gradation of halftone percent were formed on a light-sensitive material SF-100 by means of a monochromatic scanner SCANART 30 (available from Fuji Photo Film Co., Ltd.). The number of screen lines was 150 per inch.

(2) Picture taking

The original thus obtained was set for a plate-making camera C-440 available from Dainippon Screen Mfg. Co., Ltd. in an arrangement such that the enlargement magnification was equal for each direction. The original was then irradiated with light from an xenon lamp to expose the evaluation Sample.

The exposure was effected in such a manner that the portion on the evaluation sample corresponding to the 95% halftone dot area on the stepwedge was developed to form a 5% halftone dot area in the negative-positive relationship. The filter of the present invention was positioned between the original and the light source.

(3) Evaluation

The samples on which the halftone of the small dot portion (highlighted portion) had been thus adjusted were evaluated for gradation reproducibility (difficulty in dot break) on the shadowed portion by five stages (5 to 1).

2. Evaluation of picture quality of line original

An original with a reflection density of 0.5 to 1.2 on which 7th grade Ming type and Gothick type letters were photo-composed was photographed by a camera DSC351 available from Dainippon Screen Mfg. Co., Ltd. The light-sensitive material samples thus exposed were then developed under the same conditions (34° C. for 30 seconds) as in Photographic Property 1. The evaluation was effected by five stages. Level "5" indicates the most excellent quality, and Level "1" indicates the poorest quality. Levels "5" and "4" are practicable qualities. Level "3" is poor but the lower limit of the practicable quality. Levels "2" and "1" are impracticable.

The results are set forth in Table 3.

TABLE 2

| | | Hydrazine-containing layer Compound of formula (I) | | Redox compound-containing layer Compound of formula (II) | |
|---|---|---|---|---|---|
| Sample | Emulsion | Type | Added amount (mol/mol Ag) | Type | Added amount (mol/mol Ag) |
| 1 | A | I-7 | $4 \times 10^{-4}$ | — | — |
| 2* | " | " | " | II-9 | $2 \times 10^{-3}$ |
| 3* | " | " | $8 \times 10^{-4}$ | " | " |
| 4 | B | " | $4 \times 10^{-4}$ | — | — |
| 5* | " | " | " | II-9 | $2 \times 10^{-3}$ |
| 6* | " | " | $8 \times 10^{-4}$ | " | " |
| 7 | C | " | $4 \times 10^{-4}$ | — | — |
| 8* | " | " | " | II-9 | $2 \times 10^{-3}$ |
| 9* | " | " | $8 \times 10^{-4}$ | " | " |
| 10 | D | " | $4 \times 10^{-4}$ | — | — |
| 11* | " | " | " | II-9 | $2 \times 10^{-3}$ |
| 12* | " | " | $8 \times 10^{-4}$ | " | " |
| 13 | E | " | $4 \times 10^{-4}$ | — | — |
| 14 | " | " | " | II-9 | $2 \times 10^{-3}$ |
| 15 | " | " | $8 \times 10^{-4}$ | " | " |
| 16 | F | " | $4 \times 10^{-4}$ | — | — |
| 17* | " | " | " | II-9 | $2 \times 10^{-3}$ |
| 18* | " | " | $8 \times 10^{-4}$ | " | " |
| 19 | G | " | $4 \times 10^{-4}$ | — | — |
| 20* | G | I-7 | $4 \times 10^{-4}$ | II-9 | $2 \times 10^{-3}$ |
| 21* | " | " | $8 \times 10^{-4}$ | " | " |
| 22 | H | " | $4 \times 10^{-4}$ | — | — |
| 23 | " | " | " | II-9 | $2 \times 10^{-3}$ |
| 24 | " | " | $8 \times 10^{-4}$ | " | " |
| 25 | B | I-13 | $3 \times 10^{-4}$ | — | — |
| 26* | " | " | " | II-9 | $2 \times 10^{-3}$ |
| 27* | " | " | $6 \times 10^{-4}$ | " | " |
| 28 | G | " | $3 \times 10^{-4}$ | — | — |
| 29 | " | " | " | II-9 | $2 \times 10^{-3}$ |
| 30 | " | " | $6 \times 10^{-4}$ | " | " |

*Samples of the present invention

TABLE 3

| | Photographic Property 1 | | Photographic Property 2 | | Picture Quality | |
|---|---|---|---|---|---|---|
| Sample | Sensitivity | γ | Sensitivity | γ | Line Original | Enlarged |
| 1 | 100 | 18 | 81 | 15.6 | 2 | 1 |
| 2* | 89 | 16 | 70 | 15.0 | 4 | 5 |
| 3* | 98 | 17.5 | 81 | 15.4 | 4 | 5 |
| 4 | 98 | 21 | 89 | 18.6 | 2 | 1 |
| 5* | 91 | 18 | 79 | 16.6 | 4 | 5 |
| 6* | 100 | 20 | 89 | 17.8 | 4 | 5 |
| 7 | 98 | 20 | 83 | 16.2 | 2 | 1 |
| 8* | 89 | 17 | 72 | 15.0 | 4 | 5 |
| 9* | 98 | 18.4 | 81 | 16.0 | 4 | 5 |
| 10 | 105 | 19.2 | 91 | 17.0 | 2 | 2 |
| 11* | 93 | 17.1 | 79 | 16.2 | 5 | 5 |
| 12* | 100 | 18.2 | 87 | 16.9 | 5 | 5 |
| 13 | 112 | 17.0 | 91 | 14.0 | 2 | 1 |
| 14 | 93 | 13.0 | 69 | 10.2 | 4 | 5 |
| 15 | 105 | 14.8 | 78 | 12.0 | 4 | 4 |
| 16 | 100 | 18 | 81 | 14.0 | 2 | 1 |
| 17* | 87 | 13 | 63 | 10.8 | 4 | 5 |
| 18* | 93 | 16 | 69 | 13.0 | 4 | 5 |
| 19 | 107 | 17.2 | 93 | 13.8 | 1 | 1 |
| 20* | 89 | 14.0 | 61 | 10.2 | 4 | 4 |
| 21* | 95 | 15.0 | 69 | 11.4 | 4 | 4 |
| 22 | 112 | 18 | 91 | 15.0 | 1 | 1 |
| 23 | 85 | 13 | 62 | 10.2 | 4 | 4 |

TABLE 3-continued

| | Photographic Property 1 | | Photographic Property 2 | | Picture Quality | |
|---|---|---|---|---|---|---|
| Sample | Sensitivity | γ | Sensitivity | γ | Line Original | Enlarged |
| 24 | 95 | 14.3 | 74 | 10.8 | 4 | 4 |
| 25 | 107 | 20 | 100 | 18.8 | 1 | 1 |
| 26* | 93 | 17.0 | 81 | 16.0 | 4 | 5 |
| 27* | 100 | 19.8 | 89 | 16.9 | 4 | 5 |
| 28 | 110 | 18.2 | 89 | 15.7 | 1 | 1 |
| 29 | 91 | 14.8 | 67 | 11.0 | 4 | 5 |
| 30 | 100 | 16.2 | 76 | 12.9 | 4 | 4 |

*Samples of the present invention

Table 3 shows that the samples of the present invention exhibit good photographic properties and particularly Samples 2, 3, 5, 6, 8, 9, 11, 12, 26 and 27 using a silver halide emulsion having a coefficient of variation of not more than 20% exhibit little fluctuation in the photographic properties due to the processing and excellent picture qualities. Of these, Samples 5, 6, 11, 12, 26 and 27 prepared from emulsions comprising thioureas exhibit smaller fluctuation in the photographic properties due to the processing and excellent photographic properties.

EXAMPLE 2

Emulsion I

A 0.13 M aqueous solution of silver nitrate and an aqueous solution of halogen salts containing $(NH_4)_3RhCl_6$ in an amount of $1 \times 10^{-7}$ mol per mol of silver, $K_3IrCl_6$ in an amount of $2 \times 10^{-7}$ mol per mol of silver, 0.04 M potassium bromide and 0.09 M sodium chloride were added to an aqueous solution of gelatin containing sodium chloride and 1,3-dimethyl-2-imidazolidinethione with stirring at a temperature of 38° C. for 12 minutes in a double jet process to prepare silver bromochloride grains having an average grain size of 0.15 μm and a silver chloride content of 70 mol %. Thus, nuclei were formed. Then, a 0.87 M aqueous solution of silver nitrate and an aqueous solution of halogen salts containing 0.26 M potassium bromide and 0.65 M sodium chloride were similarly added to the system for 20 minutes in a double jet process. The system was then washed with water by an ordinary flocculation method. 40 g of gelatin were added to the system so that the system was adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. 150 mg of 1,3,3a,7-tetraazaindene were added to the system as stabilizer. As a result, an emulsion of cubic silver bromochloride grains having an average size of 0.28 μm and a silver chloride content of 70 mol % was obtained (coefficient of variation: 10%).

Emulsion B as prepared in Example 1 and Emulsion I were then divided into several lots. Samples 31 to 45 comprising the same additives and having the same layer structure as in Example 1 were prepared from these lots as set forth in Table 4.

These samples were then evaluated for photographic properties in the same manner as in Example 1. The results are set forth in Table 5. Table 5 shows that all of these results exhibits excellent results and the samples comprising iridium compounds particularly provide excellent photographic properties.

TABLE 4

| Sample | Emulsion | Hydrazine-containing layer Compound of formula (I) Type | Added amount (mol/mol Ag) | Redox compound-containing layer Compound of formula (II) Type | Added amount (mol/mol Ag) |
|---|---|---|---|---|---|
| 31* | B | I-7 | $4 \times 10^{-4}$ | — | — |
| 32 | " | " | $8 \times 10^{-4}$ | II-9 | $2 \times 10^{-3}$ |
| 33 | " | " | " | II-11 | " |
| 34 | " | " | " | II-24 | " |
| 35 | " | " | " | II-14 | $4 \times 10^{-3}$ |
| 36 | " | " | " | II-16 | " |
| 37* | I | " | $4 \times 10^{-4}$ | — | — |
| 38 | " | " | $8 \times 10^{-4}$ | II-9 | $2 \times 10^{-3}$ |
| 39 | " | " | " | II-11 | " |
| 40 | " | " | " | II-24 | " |
| 41 | " | " | " | II-14 | $4 \times 10^{-3}$ |
| 42 | " | " | " | II-16 | " |
| 43 | " | I-8 | $6 \times 10^{-4}$ | II-9 | $2 \times 10^{-3}$ |
| 44 | " | I-13 | $5 \times 10^{-4}$ | " | " |
| 45 | " | I-19 | $2 \times 10^{-4}$ | " | " |

*Comparative samples

TABLE 5

| Sample | Photographic Property 1 Sensitivity | γ | Photographic Property 2 Sensitivity | γ | Picture Quality Line Original | Enlarged |
|---|---|---|---|---|---|---|
| 31* | 100 | 21 | 91 | 18.2 | 2 | 1 |
| 32 | 102 | 20 | 91 | 17.6 | 4 | 5 |
| 33 | 100 | 19 | 87 | 16.8 | 3 | 4 |
| 34 | 100 | 20 | 89 | 17.7 | 4 | 5 |
| 35 | 100 | 18 | 85 | 15.9 | 3 | 4 |
| 36 | 98 | 17.9 | 85 | 16.0 | 4 | 5 |
| 37* | 95 | 22 | 89 | 19.8 | 2 | 1 |
| 38 | 95 | 20 | 87 | 19.0 | 5 | 5 |
| 39 | 93 | 20 | 85 | 18.7 | 4 | 5 |
| 40 | 95 | 21 | 83 | 18.9 | 5 | 5 |
| 41 | 93 | 19 | 81 | 17.8 | 4 | 5 |
| 42 | 91 | 18 | 79 | 16.6 | 5 | 5 |
| 43 | 100 | 20 | 91 | 18.0 | 5 | 5 |
| 44 | 102 | 21 | 93 | 18.1 | 4 | 5 |
| 45 | 107 | 21 | 95 | 18.4 | 4 | 5 |

*Comparative samples

EXAMPLE 3

Emulsions J and K were prepared as follows:

Emulsion J

An aqueous solution of silver nitrate and an aqueous of potassium iodide and potassium bromide were simultaneously added to an aqueous solution of gelatin which had been kept at a temperature of 50° C. in the presence of potassium hexachlorinated iridiumate (III) in an amount of $4 \times 10^{-7}$ mol per mol of silver and ammonia fcr 60 minutes while the pAg value of the system was maintained at 7.8. Thus, a monodisperse emulsion of cubic silver halide grains having an average size of 0.28 μm and an average silver iodide content of 0.3 mol % was prepared. The emulsion was then desalteu by a flocculation method. 40 g of inactive gelatin were added to the emulsion. The emulsion was added to a solution containing potassium iodide in an amount of $10^{-3}$ mol per mol of silver. After the lapse of 15 minutes, the system was allowed to cool.

Emulsion K

An aqueous solution of silver nitrate and an aqueous solution of sodium chloride and potassium bromide were simultaneously added to an aqueous solution of gelatin which had been kept at a temperature of 45° C. in the presence of potassium chlorinated iridiumate (III) in an amount of $4 \times 10^{-7}$ mol per mol of silver, ammonium hexachlororhodiumate (III) in an amount of $2 \times 10^{-7}$ mol per mol of silver and ammonia for 60 minutes while the pAg value of the system was maintained at 7.8. Thus, a monodisperse emulsion of cubic silver halide grains having an average size of 0.28 μm and an average silver chloride content of 70 mol % was prepared. The emulsion was then desalted by a flocculation method in the same manner as in Emulsion J. Chloroauric acid and sodium thiosulfate were then added to the emulsion in amounts of 8 mg and 5 mg, respectively, while it was maintained at a temperature of 60° C. so that it was subjected to chemical ripening. A solution containing potassium iodide in an amount of $1 \times 10^{-3}$ mol per mol of silver was added to the emulsion. After the lapse of 15 minutes, the emulsion was allowed to cool.

These emulsions were then divided into several lots. 5,5'-dichloro-9-ethyl-3,3'-bis(3-sulfopropyl)oxacarboncyanine (Sensitizing Dye 1) or 5-[3-(4-sulfobutyl)-5-chloro-2-oxazolidilidene]-1-hydroxyethyl-3-(2-pyridyl)-2-thiohydantoin (Sensitizing Dye 2) in an amount of $1 \times 10^{-3}$ mol. per mol of silver and compounds of formulae (II) and (III) as set forth in Table 6 were added to each of those lots.

A hydrazine derivative having the following formula was then added to the material in an amount of $1.5 \times 10^{-3}$ mol/m$^2$.

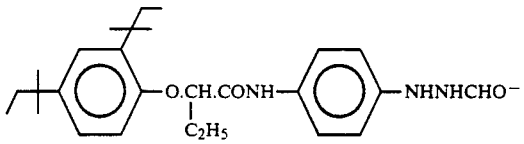

$1.5 \times 10^{-3}$ mol/m$^2$

Furthermore, 5-methylbenzotriazole, 4-hydroxy-1,3,3a,7-tetraazaindene, hydroquinone (200 mg/m$^2$), compounds having the following formulae (c), (d) and (e) (in amounts of 3.5 mg/m$^2$, 15.0 mg/m$^2$, and 200 mg/m$^2$, respectively), a polyethyl acrylate (30 wt.% based on gelatin), and a compound of the following formula (f) (2.0 wt% based on gelatin) as gelatin hardener were added to the material. Each of these emulsions were coated on a 150 μm-thick polyethylene terephthalate film having a 0.5 μm-thick subbing layer comprising a vinylidene chloride copolymer in such an amount that the coated amount of silver reached 3.4 g/m$^2$.

(c)

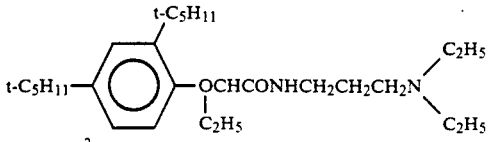

3.5 mg/m$^2$

-continued

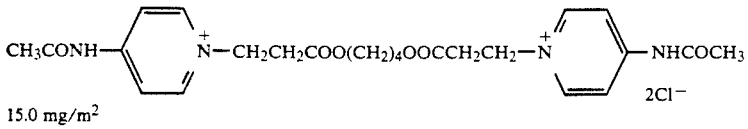

15.0 mg/m²

(e)

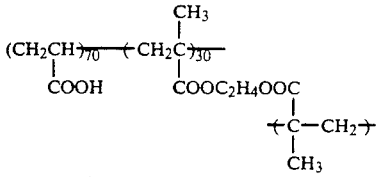

200 mg/m²

(f)

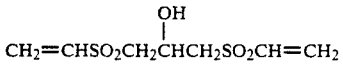

2.0 wt %

Coating of protective layer

On the coat material, 1.5 g/m² of gelatin and 0.3 g/m² of polymethyl methacrylate grains (average grain size: 2.5 μm) were coated as a protective layer with the following surface active agents in the amounts listed:

Surface active agent

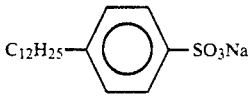

37 mg/m²

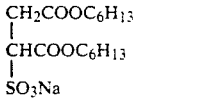

37 mg/m²

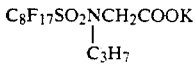

2.5 mg/m²

These samples were exposed to light from a tungsten lamp of 3,200 °K through an optical wedge and a contact screen (150L chain dot type available from Fuji Photo Film Co., Ltd.), developed with Developer II at a temperature of 34° C. for 30 seconds, fixed, washed with water, and then dried.

| Developer II | |
|---|---|
| Hydroquinone | 50.0 g |
| N-methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetracetate | 1.0 g |

-continued

| Developer II | |
|---|---|
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole) benzenesulfonate | 0.2 g |
| N-n-butyldiethanolamine | 15.0 g |
| Sodium toluenesulfonate | 8.0 g |
| Water to make | 1 l |
| pH (adjusted with potassium hydroxide) | 11.6 |

The results of the measurement of photographic properties and black pepper of these samples are set forth in Table 7. The dot gradation is represented by the following equation:

$$\text{Dot gradation} = \log E_{95\%} - \text{long } E_{5\%}$$

$E_{95\%}$: Exposure amount giving 95% dot area $E_{5\%}$: Exposure amount giving 5% dot area The dot quality is visually evaluated by five stages. In the 5-stage evaluation, Level "5" indicates the most excellent quality, and Level "1" indicates the poorest quality. Levels "5" and "4" are practicable as plate-making halftone plate precursor. Level "3" is the lower limit of practical quality. Levels "2" and "1" are impractical. The level in between Level "4" and Level "3" is Level "3.5".

The black pepper is evaluated by five stages under a microscope. Level "5" indicates the most excellent quality, and Level "1" indicates the poorest quality. Levels "5" and "4" are practicable qualities. Level "3" is poor but the lower limit of the practicable quality. Levels "2" and "1" are impracticable. The level in between Level "4" and Level "3" is Level "3.5".

TABLE 6

| | Emulsion | | | | | Compound of Formula (III) | | Compound of Formula (II) | |
|---|---|---|---|---|---|---|---|---|---|
| | | | Chemical sentization | | Sensitizing | | Added amount | | Added amount |
| Sample | Type | Halogen Composition* | Gold | Sulfur | Dye | Type | (mol/m₂) | Type | (mol/m²) |
| 46 | J | $AgBrI_{0.5}$ | None | None | 1 | — | — | — | — |
| 47 | " | " | " | " | " | — | — | II-9 | $2.0 \times 10^{-5}$ |
| 48 | " | " | " | " | " | — | — | " | $4.0 \times 10^{-5}$ |
| 49 | " | " | " | " | " | — | — | II-24 | $2.0 \times 10^{-5}$ |
| 50 | " | " | " | " | " | III-2 | $6.0 \times 10^{-6}$ | II-9 | " |
| 51 | " | " | " | " | " | " | " | " | $4.0 \times 10^{-5}$ |
| 52 | " | " | " | " | " | " | $9.0 \times 10^{-6}$ | " | $2.0 \times 10^{-5}$ |

TABLE 6-continued

| Sample | Emulsion Type | Emulsion Halogen Composition* | Chemical sentization Gold | Chemical sentization Sulfur | Sensitizing Dye | Compound of Formula (III) Type | Compound of Formula (III) Added amount (mol/m2) | Compound of Formula (II) Type | Compound of Formula (II) Added amount (mol/m²) |
|---|---|---|---|---|---|---|---|---|---|
| 53 | " | " | " | " | " | " | $6.0 \times 10^{-6}$ | II-24 | " |
| 54 | " | " | " | " | " | III-11 | " | II-9 | " |
| 55 | " | " | " | " | " | " | " | II-24 | " |
| 56 | K | $AgBrCl_{70}$ | carried out | carried out | " | — | — | — | — |
| 57 | " | " | carried out | carried out | " | — | — | II-9 | $2.0 \times 10^{-5}$ |
| 58 | " | " | carried out | carried out | " | — | — | " | $4.0 \times 10^{-5}$ |
| 59 | K | $AgBrCl_{70}$ | carried out | carried out | 1 | — | — | II-24 | $2.0 \times 10^{-5}$ |
| 60 | " | " | carried out | carried out | " | III-2 | $6.0 \times 10^{-6}$ | II-9 | " |
| 61 | " | " | carried out | carried out | " | " | " | " | $4.0 \times 10^{-5}$ |
| 62 | " | " | carried out | carried out | " | " | $9.0 \times 10^{-6}$ | " | $2.0 \times 10^{-5}$ |
| 63 | " | " | carried out | carried out | " | " | $6.0 \times 10^{-6}$ | II-24 | " |
| 64 | " | " | carried out | carried out | " | III-11 | " | II-9 | " |
| 65 | " | " | carried out | carried out | " | " | " | II-24 | " |
| 66 | J | $AgBrI_{0.5}$ | None | None | 2 | — | — | — | — |
| 67 | " | " | " | " | " | — | — | II-9 | $2.0 \times 10^{-5}$ |
| 68 | " | " | " | " | " | — | — | " | $4.0 \times 10^{-5}$ |
| 69 | " | " | " | " | " | — | — | II-24 | $2.0 \times 10^{-5}$ |
| 70 | " | " | " | " | " | III-2 | $6.0 \times 10^{-6}$ | II-9 | " |
| 71 | J | $AgBrI_{0.5}$ | None | None | 2 | III-2 | $6.0 \times 10^{-6}$ | II-9 | $4.0 \times 10^{-5}$ |
| 72 | " | " | " | " | " | " | $9.0 \times 10^{-6}$ | " | $2.0 \times 10^{-5}$ |
| 73 | " | " | " | " | " | " | $6.0 \times 10^{-6}$ | II-24 | " |
| 74 | " | " | " | " | " | III-11 | " | II-9 | " |
| 75 | " | " | " | " | " | " | " | II-24 | " |
| 76 | K | $AgBrCl_{70}$ | carried out | carried out | " | — | — | — | — |
| 77 | " | " | " | " | " | — | — | II-9 | $2.0 \times 10^{-5}$ |
| 78 | " | " | " | " | " | — | — | " | $4.0 \times 10^{-5}$ |
| 79 | " | " | " | " | " | — | — | II-24 | $2.0 \times 10^{-5}$ |
| 80 | " | " | " | " | " | III-2 | $6.0 \times 10^{-6}$ | II-9 | " |
| 81 | " | " | " | " | " | " | " | " | $4.0 \times 10^{-5}$ |
| 82 | " | " | " | " | " | " | $9.0 \times 10^{-6}$ | " | $2.0 \times 10^{-5}$ |
| 83 | K | $AgBrCl_{70}$ | carried out | carried out | 2 | III-2 | $6.0 \times 10^{-6}$ | II-24 | $2.0 \times 10^{-5}$ |
| 84 | " | " | carried out | carried out | " | III-11 | " | II-9 | " |
| 85 | " | " | carried out | carried out | " | " | " | II-24 | " |

*Subscript shows the content of the indicated halogen in terms of mol %; e.g., $AgBrCl_{70}$ means 70 mol % of Cl and 30 mol % Br in the halogen composition.

TABLE 7

| Sample | Photographic Property γ | Photographic Property Dot gradation | Photographic Property Dot quality | Black Pepper |
|---|---|---|---|---|
| 46 | 14.3 | 1.25 | 3 | 2.5 |
| 47 | 8.1 | 1.40 | 2 | 3 |
| 48 | 7.2 | 1.42 | 2 | 3 |
| 49 | 7.8 | 1.40 | 2 | 3 |
| 50 | 8.3 | 1.39 | 2 | 4.5 |
| 51 | 7.4 | 1.42 | 2 | 4.5 |
| 52 | 8.2 | 1.40 | 2 | 5 |
| 53 | 8.0 | 1.41 | 2 | 4.5 |
| 54 | 8.2 | 1.39 | 2 | 5 |
| 55 | 8.1 | 1.40 | 2 | 5 |
| 56 | 16.0 | 1.22 | 3 | 2 |
| 57 | 15.4 | 1.38 | 4.5 | 3 |
| 58 | 14.9 | 1.42 | 5 | 3 |
| 59 | 15.2 | 1.39 | 4.5 | 3 |
| 60 | 15.5 | 1.39 | 4.5 | 4.5 |
| 61 | 14.8 | 1.40 | 5 | 4.5 |
| 62 | 15.3 | 1.41 | 4.5 | 5 |
| 63 | 15.1 | 1.39 | 4.5 | 4.5 |
| 64 | 15.8 | 1.40 | 4.5 | 5 |
| 65 | 15.5 | 1.40 | 4.5 | 5 |
| 66 | 15.1 | 1.20 | 3 | 2.5 |

TABLE 7-continued

| Sample | Photographic Property γ | Photographic Property Dot gradation | Photographic Property Dot quality | Black Pepper |
|---|---|---|---|---|
| 67 | 7.0 | 1.38 | 2 | 3 |
| 68 | 6.2 | 1.41 | 1 | 3 |
| 69 | 7.1 | 1.39 | 2 | 3 |
| 70 | 7.0 | 1.38 | 2 | 4.5 |
| 71 | 6.4 | 1.40 | 1 | 5 |
| 72 | 7.1 | 1.39 | 2 | 4.5 |
| 73 | 7.0 | 1.40 | 2 | 4.5 |
| 74 | 7.3 | 1.40 | 2 | 5 |
| 75 | 7.0 | 1.39 | 2 | 4.5 |
| 76 | 17.2 | 1.21 | 3 | 2 |
| 77 | 17.0 | 1.40 | 4.5 | 3 |
| 78 | 16.5 | 1.42 | 5 | 3 |
| 79 | 17.2 | 1.39 | 5 | 3 |
| 80 | 17.3 | 1.40 | 4.5 | 4.5 |
| 81 | 16.4 | 1.43 | 5 | 4.5 |
| 82 | 17.1 | 1.41 | 4.5 | 5 |
| 83 | 16.9 | 1.39 | 5 | 4.5 |
| 84 | 17.0 | 1.38 | 5 | 5 |
| 85 | 16.8 | 1.40 | 5 | 4.5 |

Samples 46 to 56 and 66 to 76 are comparative samples; Samples 57 to 59 and 77 to 79 are reference samples; and the others are the samples of the present invention.

The samples of the present invention maintain a high contrast and exhibit a wide dot gradation. In respect to dot quality, samples 46, 56, 66 and 76 provide jagged dots and lack smoothness in dot edge portions. Samples 47 to 55, and 67 to 75 exhibit a low optical density and look unsharp. On the other hand, the samples of the present invention exhibit a high optical density and a high smoothness, and they exhibit some improvements in inhibition of black pepper as compared to Samples 57 to 59, and 77 to 79.

EXAMPLE 4

Preparation of emulsion for hydrazine-containing layer

Emulsion L

A 0.37 M aqueous solution of silver nitrate and an aqueous solution of halogen salts containing $(NH_4)_3RhCl_6$ in an amount of $1\times10^{-7}$ mol per mol of silver, $K_3IrCl_6$ in an amount of $5\times10^{-7}$ mol per mol of silver, 0.11 M potassium bromide and 0.27 M sodium chloride were added to an aqueous solution of gelatin containing sodium chloride and 1,3-dimethyl-2-imidazolidinethione with stirring at a temperature of 45° C. for 12 minutes in a double jet process to prepare silver bromochloride grains having an average grain size of 0.20 μm and a silver chloride content of 70 mol %. Thus, nuclei were formed. Then, a 0.03 M aqueous solution of silver nitrate and an aqueous solution of halogen salts containing 0.19 M potassium bromide and 0.47 M sodium chloride were similarly added to the system in 20 minutes in a double jet process.

A solution containing $1\times10^{-3}$ mol of potassium iodide was added to the system to effect conversion. The system was then washed with water by an ordinary flocculation method. 40 g of gelatin were added to the system. The system was then adjusted to a pH value of 6.5 and a pAg value of 7.5. Sodium thiosulfate, chloroauric acid and sodium benzenethiosulfonate were then added to the system in amounts of 5 mg, 8 mg and 7 mg per mol of silver, respectively. The system was heated to a temperature of 60° C. for 45 minutes so that it was chemically sensitized. 150 mg of 1,3,3a,7-tetraazaindene and proxel and phenoxy ethanol were added to the system as stabilizers. 5-[3-(4-sulfobutyl)-5-chloro-2-oxazolidilidene]-1-hydroxyethyl3-(2-pyridyl) -2-thiohydantoin was added to the emulsion as a sensitizing dye in an amount of $1\times10^{-3}$ mol per mol of silver. As a result, an emulsion of cubic silver bromochloride grains having an average size of 0.28 μm and a silver chloride content of 70 mol % was obtained (coefficient of variation: 9%.

The emulsions was then divided into several lots. 1-phenyl-5-mercaptotetrazole ($2\times10^{-4}$ mol), a short-wave cyanine dye represented by the following structural formula (g) ($5\times10^{-4}$ mol), a water-soluble latex represented by the following structural formula (h) (200 mg/m$^2$), hydroquinone (50 mg/m$^2$), a polyethyl acrylate dispersion (200 mg/m$^2$), 1,2-bis-(vinylsulfonylacetamide)ethane as film hardener, and a hydrazine compound of the present invention as set forth in Table 8 were added to each of these lots.

(g)

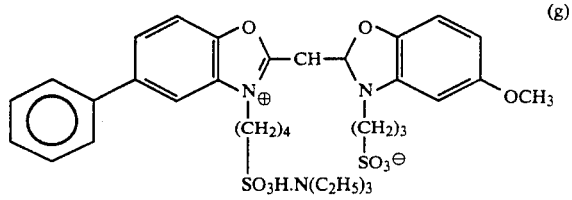

(h)

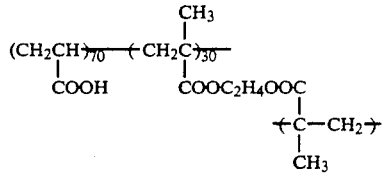

Preparation of emulsion of redox compound-containing layer

Emulsion M

A 1.0 M aqueous solution of silver nitrate and an aqueous solution of halogen salts containing $(NH_4)_3RhCl_6$ in an amount of $3\times10^{-7}$ mol per mol of silver, 0.3 M potassium bromide and 0.74 M sodium chloride were added to an aqueous solution of gelatin containing sodium chloride and 1,3-dimethyl-2-imidazolidinethione with stirring at a temperature of 45° C. for 30 minutes in a double jet process to prepare silver bromochloride grains having an average grain size of 0.28 μm and a silver chloride content of 70 mol %. The system was then washed with water by an ordinary flocculation method. 40 g of gelatin were added to the system so that the system was adjusted to a pH value of 6.5 and a pAg value of 7.5. Sodium thiosulfate and chloroauric acid were then added to the system in amounts of 5 mg and 8 mg per mol of silver, respectively. The system was heated to a temperature of 60° C. for 60 minutes so that it was chemically sensitized. 150 mg of 1,3,3a,7-tetraazaindene were added to the system as stabilizer. As a result, an emulsion of cubic silver bromochloride grains having an average size of 0.28 μm and a silver chloride content of 70 mol % was obtained (coefficient of variation: 10%).

The emulsion was divided into several lots. 5-[3-(4-sulfobutyl)-5-chloro-2-oxazolidilidene]-1-hydroxyethyl-3-(2-pyridyl) -2-thiohydantoin in an amount of $1\times10^{-3}$ mol per mol of silver, 1-phenyl-5-mercaptotetrazole in an amount of $2\times10^{-4}$ mol per mol of silver, a polyethyl acrylate dispersion in an amount of 50 mg/m$^2$, 1,2-bis(-vinylsulfonylacetamide)ethane in an amount of 40 mg/m$^2$, and a redox compound of formula (II) of the present invention as set forth in Table 8 were added to each these lots.

A hydrazine-containing layer (Ag content: 3.6 g/m$^2$; gelatin content: 2 g/m$^2$) as the lowest layer, an interlayer (gelatin content: 0.5 g/m$^2$), a redox compound-containing layer (Ag content: 0.4 g/m$^2$; gelatin content: 0.5 g/m$^2$) and a protective layer containing 1.0 g/m$^2$ of gelatin, 40 mg of an amorphous $SiO_2$ matting agent having a grain size of about 3.5 μm, 0.1 g/m$^2$ of methanol silica, 100 mg/m$^2$ of polyacrylamide, 200 mg/m$^2$ of hydroquinone, silicone oil and a fluorine surface active agent of the structural formula:

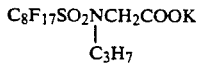

and sodium dodecylbenzenesulfonate as coating aids were simulatneously coated on a support in this order to prepare samples as set forth in Table 8.

On the back surface of the support were provided a back layer and a protective layer therefor, each having the following formulation:

| Formulation of back layer | |
|---|---|
| Gelatin | 3 g/m$^2$ |
| Latex of polyethyl acrylate | 2 g/m$^2$ |
| Surface active agent (sodium p-dodecylbenzenesulfonate) | 40 mg/m$^2$ |
| Gelatin hardener | |
| 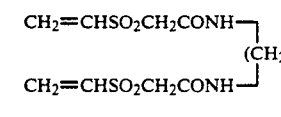 | 110 mg/m$^2$ |
| Dye (mixture of Dye [a], Dye [b] and Dye [c] as previously set forth) | |
| Dye [a] | 50 mg/m$^2$ |
| Dye [b] | 100 mg/m$^2$ |
| Dye [c] | 50 mg/m$^2$ |
| Formulation of back protective layer | |
| Gelatin | 0.8 g/m$^2$ |
| Finely divided polymethyl methacrylate grains (average grain diameter: 4.5 μm) | 30 mg/m$^2$ |
| Sodium dihexyl-α-sulfosuccinate | 15 mg/m$^2$ |
| Sodium dodecylbenzenesulfonate | 15 mg/m$^2$ |
| Fluorine surface active agent | 5 mg/m$^2$ |
| 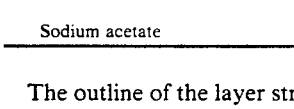 | |
| Sodium acetate | 40 mg/m$^2$ |

The outline of the layer structure is shown in FIG. 1.

The samples thus obtained were then stored at a temperature of 25° C. and a relative humidity of 65% for 10 days, and evaluated for percent swelling.

The evaluation of percent swelling was conducted as follows:

Percent swelling

The percent swelling was determined is described above, i.e., by the following steps:

a) The total thickness of the hydrophilic colloidal layers in the silver halide photographic material (excluding the layers on the back surface of the material) is measured;

b) The silver halide photographic material is dipped in distilled water at a temperature of 25° C. for 1 minute; and c) The percentage of the increase in the total thickness of the hydrophilic colloidal layers from the initial value is determined.

$$\text{Percent swelling} = \frac{\text{Increase in thickness } (\mu m) \text{ after being dipped in 25° C.-distilled water}}{\text{Thickness } (\mu m) \text{ of hydrophilic colloidal layers}} \times 100(\%)$$

These samples were exposed to light from a tungsten lamp of 3,200° K. through an optical wedge and a contact screen (150L chain dot type available from Fuji Photo Film Co., Ltd.), developed with Developer III at a temperature of 34° C. for 30 seconds, fixed, washed with water, and then dried.

| Developer III | |
|---|---|
| Hydroquinone | 50.0 g |
| N-methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidiazole-5-sulfonic acid | 0.3 g |
| Sodium 3-(5-mercaptotetrazole) benzenesulfonate | 0.2 g |
| 6-Dimethylamino-1-hexanol | 4.0 g |
| Sodium toluenesulfonate | 8.0 g |
| Water to make | 1 l |
| pH (adjusted with potassium hydroxide) | 11.6 |

The results of the measurement of photographic properties (dot gradation and γ), black pepper and percent swelling of these samples are set forth in Table 8.

TABLE 8

| | Hydrazine-containing layer | | | Redox compound-containing Layer | | | | | | |
|---|---|---|---|---|---|---|---|---|---|---|
| | | Compound of Formula (I) | | Compound of Formula (II) | | Added Amount of Gelatin | Percent | | Dot | |
| Sample | Type of Emulsion | Type | Added amount (mol/m$^2$) | Type | Added Amount (mol/m$^2$) | Hardner (g/m$^2$) | Swelling (%) | γ | Grata-tion | Black Pepper |
| 86 | L | I-7 | $1.0 \times 10^{-5}$ | — | — | 0.200 | 80 | 11.2 | 1.20 | 1 |
| 87 | " | " | " | II-9 | $0.5 \times 10^{-4}$ | " | " | 8.3 | 1.35 | 1.5 |
| 88 | " | " | " | II-27 | " | " | " | 7.5 | 1.38 | 2 |
| 89 | " | " | " | — | — | 0.170 | 130 | 16.1 | 1.22 | 3 |
| 90 | " | " | " | II-9 | $0.5 \times 10^{-4}$ | " | " | 17.2 | 1.40 | 5 |
| 91 | " | " | " | — | — | 0.160 | 140 | 17.8 | 1.22 | 3 |
| 92 | " | " | " | II-9 | $0.5 \times 10^{-4}$ | " | " | 16.9 | 1.40 | 4.5 |
| 93 | " | " | " | " | $1.0 \times 10^{-4}$ | " | " | 16.3 | 1.43 | 5 |
| 94 | " | " | " | II-27 | $0.5 \times 10^{-4}$ | " | " | 17.2 | 1.39 | 5 |
| 95 | " | " | " | " | $1.0 \times 10^{-4}$ | " | " | 16.8 | 1.44 | 5 |
| 96 | " | " | " | — | — | 0.140 | 160 | 17.6 | 1.21 | 3 |
| 97 | " | " | " | II-9 | $0.5 \times 10^{-4}$ | — | — | 17.0 | 1.39 | 5 |
| 98 | " | " | " | — | — | 0.110 | 230 | 16.4 | 1.23 | 3 |
| 99 | L | I-7 | $1.0 \times 10^{-5}$ | II-9 | $0.5 \times 10^{-4}$ | 0.110 | 230 | 17.5 | 1.26 | 4 |
| 100 | " | " | " | II-27 | " | " | " | 15.9 | 1.27 | 4.5 |
| 101 | " | I-19 | $0.5 \times 10^{-6}$ | — | — | 0.200 | 80 | 10.9 | 1.21 | 1 |
| 102 | " | " | " | II-9 | $0.5 \times 10^{-4}$ | " | " | 8.0 | 1.39 | 1.5 |

TABLE 8-continued

| | Hydrazine-containing layer | | | Redox compound-containing Layer | | | | | | |
|---|---|---|---|---|---|---|---|---|---|---|
| | | Compound of Formula (I) | | Compound of Formula (II) | | Added Amount of Gelatin | Percent | | Dot | |
| Sample | Type of Emulsion | Type | Added amount (mol/m$^2$) | Type | Added Amount (mol/m$^2$) | Hardner (g/m$^2$) | Swelling (%) | $\gamma$ | Grata-tion | Black Pepper |
| 103 | " | " | " | II-27 | " | " | " | 8.4 | 1.41 | 1.5 |
| 104 | " | " | " | — | — | 0.160 | 140 | 1.68 | 1.20 | 3 |
| 105 | " | " | " | II-9 | $0.5 \times 10^{-4}$ | " | " | 16.6 | 1.42 | 5 |
| 106 | " | " | " | " | " | 0.140 | 160 | 17.0 | 1.41 | 4.5 |
| 107 | " | " | " | — | — | 0.110 | 230 | 17.1 | 1.20 | 3 |
| 108 | " | " | " | II-9 | $0.5 \times 10^{-4}$ | " | " | 16.9 | 1.23 | 4 |
| 109 | " | " | " | II-27 | " | " | " | 16.5 | 1.24 | 4.5 |
| 110 | " | I-7<br>I-19 | $0.7 \times 10^{-5}$<br>$0.3 \times 10^{-6}$ | II-9 | " | 0.200 | 80 | 7.8 | 1.40 | 2 |
| 111 | L | I-7<br>I-19 | $0.7 \times 10^{-5}$<br>$0.3 \times 10^{-6}$ | — | — | 0.170 | 130 | 17.1 | 1.21 | 3 |
| 112 | " | I-7<br>I-19 | $0.7 \times 10^{-5}$<br>$0.3 \times 10^{-6}$ | II-9 | $0.5 \times 10^{-4}$ | " | " | 17.3 | 1.43 | 5 |
| 113 | " | I-7<br>I-19 | $0.7 \times 10^{-5}$<br>$0.3 \times 10^{-6}$ | " | " | 0.160 | 140 | 16.9 | 1.42 | 5 |
| 114 | " | I-7<br>I-19 | $0.7 \times 10^{-5}$<br>$0.3 \times 10^{-6}$ | " | " | 110 | 230 | 17.0 | 1.24 | 4.5 |

Samples 86, 89, 91, 96, 98, 101, 104, 107 and 111 are comparative samples; samples 87, 88, 99, 100, 102, 103, 108, 109, 110, and 114 are reference samples; and the others are the samples of the present invention.

The samples of the present invention maintain a high contrast and exhibit a wide dot gradation and improvements in inhibition of black pepper. On the other hand, the comparative or reference samples 86 to 88, 101 to 103 and 110, which exhibit a low percent swelling exhibit remarkable black pepper and lack contrast. Furthermore, the comparative or reference samples 98 to 100, 107 to 109 and 114 which exhibit a high percent swelling exhibit some improvement in inhibition of black pepper but exhibit a remarkably narrow dot gradation as compared to the present samples.

EXAMPLE 5

Preparation of emulsion for hydrazine-containing layer

Emulsion N

An aqueous solution of silver nitrate and an aqueous solution of sodium chloride were simultaneously added to an aqueous solution of gelatin which had been maintained at a temperature of 50° C. in the presence of $(NH_4)_3RhCl_6$ in an amount of $5.0 \times 10^{-6}$ mol per mol of silver. Soluble salts were removed from the emulsion by a method well known in the art. Gelatin was then added to the emulsion. The emulsion was not subjected to chemical ripening. 2-Methyl-4-hydroxy-1,3,3a,7-tetraazaindene was added to the emulsion as stabilizer. As a result, a monodispersed emulsion of cubic silver halide grains having an average size of 0.15 μm was obtained.

To the emulsion was added 15 mg/m$^2$ of a hydrazine compound of the following formula:

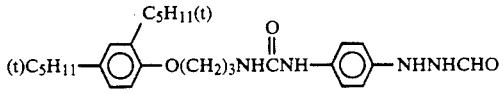

200 mg/m$^2$ of a polyethyl acrylate dispersion was added to the emulsion. As film hardener, 1,2- bis(vinylsulfonylacetamide)ethane was added to the emulsion as set forth in Table 9.

Preparation of emulsion for redox compound-containing layer 50 mg/m$^2$ of a polyethyl acrylate dispersion, 40 mg/m$^2$ of 1,2-bis(vinylsulfonylacetamide)ethane, and a redox compound of formula (II) of the present invention were added to Emulsion N as set forth above.

On a 150 μm-thick polyester film support were coated the hydrazine-containing layer (silver content: 3.6 g/m$^2$; gelatin content: 2 g/m$^2$) as lowermost layer, an interlayer (gelatin content: 0.5 g/m$^2$), the redox compound-containing layer (silver content: 0.4 g/m$^2$; gelatin content: 0.5 g/m$^2$), and a protective layer containing 1.0 g/m$^2$ of gelatin, 0.3 g/m$^2$ of polymethyl methacrylate grains (average diameter: 2.5 μm) as a matting agent, and surface active agents of the following formulae as coating aid, a stabilizer and an ultraviolet-absorbing dye (which are shown as follows) in this order. The coat material was then dried.

Surface active agent

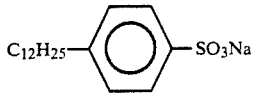

37 mg/m$^2$

-continued $CH_2COOC_6H_{13}$
|
$CHCOOC_6H_{13}$ — 37 mg/m²
|
$SO_3Na$ $C_8F_{17}SO_2N(C_3H_7)CH_2COOK$ — 2.5 mg/m²

Stabilizer

Thioctic acid — 2.1 mg/m²

Ultraviolet-absorbing dye

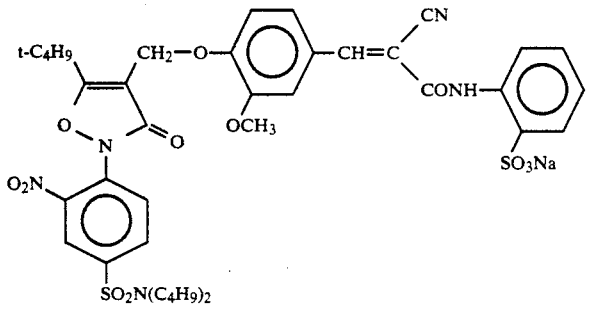

100 mg/m²

Figure 2:
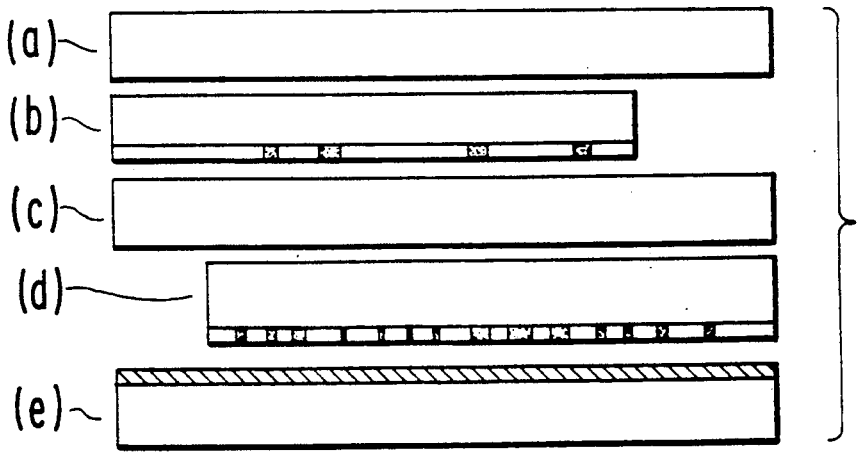
FIG. 2 is a block diagram illustrating the exposure arrangement for the formation of an extract letter image in a photomechanical processing in which a, b, c, d and e indicate a transparent or semitransparent laminating base, line original (black portion indicates line), transparent or semitransparent laminating base, dot original (black portion indicates line), and a light-sensitive material (shade portion indicates light-sensitive layer), respectively.

The samples thus obtained was then imagewise exposed to light through an original as shown in FIG. 2 in a daylight printer p-607 available from Dainippon Screen Mfg. Co., Ltd., developed at a temperature of 38° C. for 20 seconds, fixed, washed with water, dried, and evaluated for extract letter quality.

Extract Letter Quality 5 is an extraordinarily excellent extract letter quality in which a letter having a width of 30 μm can be reproduced when a light-sensitive material is exposed to an original as shown in FIG. 2 in such a manner that a dot area of 50% on the original corresponds to a dot area of 50% on the light-sensitive material. On the other hand, Extract Letter Quality 1 is a poor extract letter quality in which only letters having a width of 150 μm or more can be reproduced under the same exposure conditions. Extract Letter Qualities 2, 3 and 4 are organoleptically defined between Extract Letter Quality 1 and Extract Letter Quality 5. Extract Letter Quality 3 is the lower limit of practical level.

The results are set forth in Table 9. The samples of the present invention (Samples 118, 120 and 121) exhibit excellent extract letter qualities.

TABLE 9

| | Compound of formula (II) | | | | |
|---|---|---|---|---|---|
| Sample | Type | Added amount (mol/m²) | Added amount of gelatin hardner (g/m²) | Percent swelling (%) | Extract letter quality |
| 115 | — | — | 0.200 | 85 | 1 |
| 116 | II-24 | $0.5 \times 10^{-4}$ | " | " | 2 |
| 117 | — | — | 0.175 | 130 | 3 |
| 118 | II-9 | $0.5 \times 10^{-4}$ | " | " | 5 |
| 119 | — | — | 0.160 | 150 | 3 |
| 120 | II-9 | $0.5 \times 10^{-4}$ | " | " | 5 |
| 121 | II-24 | " | 0.155 | 160 | 4.5 |
| 122 | — | — | 0.140 | 230 | 3 |
| 123 | II-9 | $0.5 \times 10^{4}$ | " | " | 3 |

While the invention has been described in detail and with reference to specific embodiments thereof, it will be apparent to one skilled in the art that various changes and modifications can be made therein without departing from the spirit and scope thereof.

What is claim is:

1. A negative-working type silver halide photographic material comprising a support having thereon at least one light-sensitive silver halide emulsion layer containing a hydrazine derivative, wherein said silver halide emulsion comprises monodispersed silver halide grains comprising 50 mol% or more of silver chloride, and said hydrazine derivative is a compound represented by formula (I):

$$R_1-\underset{\underset{A_1}{|}}{N}-\underset{\underset{A_2}{|}}{N}-G_1-R_2 \qquad (I)$$

wherein $R_1$ represents an aliphatic or an aromatic group; $R_2$ represents a hydrogen atom, alkyl group, aryl group, alkoxy group, aryloxy group, amino group or hydrozino group; $G_1$ represents $$-\overset{\overset{O}{\|}}{C}-\text{ group, } -SO_2-\text{ group, } -SO-\text{ group,}$$

$$-\underset{\underset{R_2}{|}}{\overset{\overset{O}{\|}}{P}}-\text{ group, } -\overset{\overset{O}{\|}}{C}-\overset{\overset{O}{\|}}{C}-\text{ group,}$$

thiocarbonyl group or iminomethylene group; and $A_1$ and $A_2$ each represents a hydrogen atom or one of $A_1$ and $A_2$ represents a hydrogen atom and the other represents a substituted or unsubstituted alkylsulfonyl group, substituted or unsubstituted arylsulfonyl group or substituted or unsubstituted acryl group, wherein said emulsion layer or another hydrophilic colloidal layer provided on the support contains at least one redox compound capable of releasing a development inhibitor upon oxidation, said redox compound is represented by formula (II-1), (II-2) or (II-3):

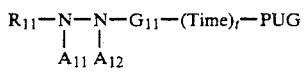

(II-1)

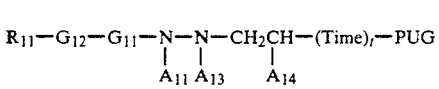

(II-2)

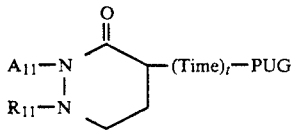

(II-3)

wherein $R_{11}$ represents an aliphatic group of aromatic group; $G_{11}$ represents

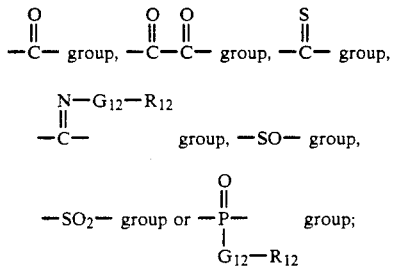

$G_{12}$ represents a mere bond, —O—, —S— or

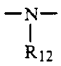

in which $R_{12}$ represents a hydrogen atom or $R_{11}$); $A_{11}$ and $A_{12}$ each represents a hydrogen atom, alkylsulfonyl group, arylsulfonyl group or acryl group, all of which may be substituted; at least one of $A_{11}$ and $A_{12}$ in formula (II-1) is a hydrogen atom; $A_{13}$ has the same meaning as $A_{11}$ or represents

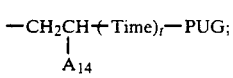

$A_{14}$ represents a nitro group, cyano group, carboxyl group, sulfo group or $—G_{11}—G_{12}—R_{11}$; Time represents a divalent linking group; t represents an integer 0 or 1; and PUG represents a development inhibitor.

2. The silver halide photographic material as claimed in claim 1, wherein said silver halide emulsion is a monodispersed emulsion having a coefficient of variation of 20% or less.

3. The silver halide photographic material as claimed in claim 1, wherein said silver halide emulsion is obtained by the formation of grains in the presence of a 4-substituted thiourea compound.

4. The silver halide photographic material as claimed in claim 1, wherein said silver halide emulsion is obtained by the formation of grains in the presence of an iridium complex salt.

5. The silver halide photographic material as claimed in claim 1, wherein said redox compound contains a redox group selected from the group consisting of hydroquinones, catechols, naphthoquinones, aminophenols, pyrazolidones, hydrazines, hydroxylamines and reductones.

6. The silver halide photographic material as claimed in claim 5, wherein said redox group is a hydrazine.

7. The silver halide photographic material as claimed in claim 1, wherein at least one of said emulsion layer and other hydrophilic colloidal layers contains a compound of formula (III):

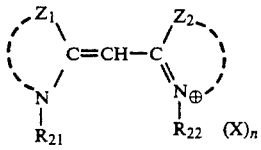

(III)

wherein $Z_1$ and $Z_2$ each represents a nonmetallic atom group required to form benzoxazole nucleus, benzothiazole nucleus, benzoselenazole nucleus, naphthoxazole nucleus, naphthothiazole nucleus, naphthoselenazole nucleus, thiazole nucleus, thiazoline nucleus, oxazole nucleus, selenazole nucleus, selenazoline nucleus, pyridine nucleus, benzimidazole nucleus or quinoline nucleus; $R_{21}$ and $R_{22}$ each represents an alkyl group or aralkyl group; X represents a charge-balanced paired ion; and n represents an integer 0 or 1.

8. The silver halide photographic material as claimed in claim 1, further comprising a second light-sensitive silver halide emulsion layer on the same side of the support as the layer containing the hydrazine derivative, wherein the side of the material having said light-sensitive silver halide emulsion layers exhibits a percent swelling of 100 to 200%.

9. The silver halide photographic material as claimed in claim, 1, wherein said hydrazine derivative is present in an amount of about $1\times10^{-6}$ mol to about $5\times10^{-2}$ mol per mol of silver halide contained in said light-sensitive silver halide emulsion layer.

10. The silver halide photographic material as claimed in claim 9, wherein the amount of said hydrazine derivative is $1\times10^{-5}$ mol to $2\times10^{-2}$ mol.

11. The silver halide photographic material as claimed in claim 1, wherein said redox compound is present in an amount of about $1\times10^{-6}$ mol to about $5\times10^{-2}$ mol per mol of silver halide contained in the layer containing said redox compound and a layer or layers adjacent thereto.

12. The silver halide photographic material as claim 11, wherein the amount of said redox compound is $1\times10^{-5}$ mol to $1\times10^{-2}$ mol.

13. The silver halide photographic material as claimed in claim 1, wherein the layer containing the redox compound is provided on or under the light-sensitive emulsion layer containing the hydrazine derivative.

14. The silver halide photographic material as claimed in claim 1, wherein the layer containing the redox compound is a silver halide emulsion layer.

15. The silver halide photographic material as claimed in claim 1, wherein said monodispersed grains have an average size of about 0.7 μm or less.

16. The silver halide photographic material as claimed in claim 1, wherein said emulsion has a silver iodide content of 3 mol % or less.

* * * * *